US012258767B2

(12) United States Patent
Tabibnia

(10) Patent No.: US 12,258,767 B2
(45) Date of Patent: Mar. 25, 2025

(54) BRACED FLOORING TRAY SUPPORT SYSTEM AND METHOD

(71) Applicant: Ramin Tabibnia, Los Angeles, CA (US)

(72) Inventor: Ramin Tabibnia, Los Angeles, CA (US)

( * ) Notice: Subject to any disclaimer, the term of this patent is extended or adjusted under 35 U.S.C. 154(b) by 269 days.

(21) Appl. No.: 17/687,581

(22) Filed: Mar. 4, 2022

(65) Prior Publication Data

US 2022/0282495 A1 Sep. 8, 2022

Related U.S. Application Data

(60) Provisional application No. 63/156,380, filed on Mar. 4, 2021.

(51) Int. Cl.
*E04F 15/00* (2006.01)
*E04F 15/02* (2006.01)
*E04F 15/024* (2006.01)

(52) U.S. Cl.
CPC .. *E04F 15/02452* (2013.01); *E04F 15/02183* (2013.01); *E04F 15/02494* (2013.01)

(58) Field of Classification Search
None
See application file for complete search history.

(56) References Cited

U.S. PATENT DOCUMENTS 2,867,301 A 1/1959 Benton
3,100,624 A 8/1963 Spiselman
3,222,030 A 12/1965 Thorpe
3,470,663 A 10/1969 Tate
3,616,584 A 11/1971 Sartori et al.
3,924,370 A 12/1975 Cauceglia et al.
4,068,442 A 1/1978 Troutner
4,085,557 A 4/1978 Tharp
4,214,410 A 7/1980 Mitsueda
4,277,923 A 7/1981 Rebentisch et al.
(Continued)

FOREIGN PATENT DOCUMENTS

DE 29822767 U1 3/1999
WO 2014160076 A1 10/2014

*Primary Examiner* — Steven M Marsh
(74) *Attorney, Agent, or Firm* — Lance M. Pritikin

(57) ABSTRACT

Exemplary implementations of a braced flooring tray support system comprise a braced pedestal subsystem and one or more trays. The braced pedestal subsystem may include several pedestals rigidly interconnected by several brace elements. The pedestals may include position-adjustable brace interface elements having vertical fins or an annular flange projecting radially. The tray corners are supported by respective pedestals. The brace elements may have an opposing pair of pedestal interface portions which include a fin-receiving or flange-receiving slot, and a pair of pin alignment apertures intersecting the slot. Brace fasteners configured to be manually installed in and removed from the pedestal interface portions. Each brace fastener may include a pair of fastener pins configured to extend through respective pin alignment apertures and respective attachment apertures when the brace fastener is installed. The fastener pins may include a detent portion configured to releasably secure the installation without requiring any threaded engagement.

19 Claims, 26 Drawing Sheets

(56) References Cited

U.S. PATENT DOCUMENTS 4,348,843 A 9/1982 Cairns et al.
4,417,426 A 11/1983 Meng
4,546,581 A 10/1985 Gustafson
4,685,258 A * 8/1987 Av-Zuk ..... E04F 15/02452 52/126.6
4,780,571 A 10/1988 Huang
4,905,437 A 3/1990 Heather
4,996,804 A 3/1991 Naka et al.
5,359,821 A 11/1994 Merriman
5,398,466 A 3/1995 Oyama et al.
5,412,914 A 5/1995 Daw et al.
5,791,096 A * 8/1998 Chen ..... E04F 15/02452 52/220.1
5,862,635 A 1/1999 Linse et al.
5,946,867 A 9/1999 Snider, Jr. et al.
6,243,996 B1 6/2001 Oliver et al.
6,363,685 B1 4/2002 Kugler
6,370,831 B1 4/2002 Marshall et al.
6,634,150 B1 10/2003 Oliver et al.
6,754,992 B1 6/2004 Byfield et al.
6,918,217 B2 7/2005 Jakob-Bamberg et al.
7,275,731 B1 10/2007 Shinault
8,181,399 B2 5/2012 Knight, III et al.
8,381,461 B2 2/2013 Repasky
8,453,391 B2 6/2013 Tabibnia
8,667,747 B2 3/2014 Repasky
8,850,753 B2 10/2014 Tabibnia
8,898,999 B1 12/2014 Kugler et al.
9,038,324 B2 5/2015 Kugler et al.
9,284,693 B2 3/2016 Tabibnia
9,410,296 B2 8/2016 Tabibnia
9,556,621 B2 1/2017 Pelc et al.
9,874,029 B2 1/2018 Kugler et al.
9,879,385 B2 1/2018 Tabibnia
10,106,991 B2 10/2018 Dombrowski et al.
10,415,191 B2 9/2019 Tabibnia
10,844,613 B2 11/2020 Repasky et al.
11,168,447 B2 11/2021 Repasky et al.
2004/0035064 A1 2/2004 Kugler et al.
2004/0261329 A1 12/2004 Kugler et al.
2008/0105172 A1 5/2008 Repasky
2008/0222973 A1 9/2008 Lee et al.
2009/0188189 A1 7/2009 Repasky
2010/0000163 A1* 1/2010 Tsai ..... F16F 1/44 52/126.6
2011/0011012 A1 1/2011 Knight, III et al.
2011/0016809 A1 1/2011 Knight, III et al.
2011/0239550 A1* 10/2011 Kugler ..... E04F 15/0247 52/126.6
2012/0291369 A1* 11/2012 Knight, III ..... E04F 15/0247 52/126.5
2016/0040439 A1 2/2016 Pelc et al.
2017/0152665 A1 6/2017 Pelc, Jr. et al.
2021/0062519 A1 3/2021 Bordin
2022/0025586 A1 1/2022 Repasky et al.
2022/0056707 A1 2/2022 Buzon
2023/0304229 A1* 9/2023 Tabibnia ..... B32B 3/30
2023/0374794 A1* 11/2023 Repasky ..... E04F 15/02458

* cited by examiner

BRACED FLOORING TRAY SUPPORT SYSTEM AND METHOD

RELATED APPLICATIONS

This application claims the benefit of U.S. Provisional Application No. 63/156,380 filed Mar. 4, 2021, the content of which is incorporated by this reference in its entirety for all purposes as if fully set forth herein.

TECHNICAL FIELD

The present disclosure relates generally to the field of raised deck and flooring systems.

BACKGROUND

Conventional pedestal-tray raised deck support systems lack certain features that facilitate ease of assembly, configurability and manufacturability of the system.

SUMMARY

Certain deficiencies of the prior art may be overcome by the provision of a braced flooring tray support system and method, certain non-limiting embodiments of which are disclosed herein.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
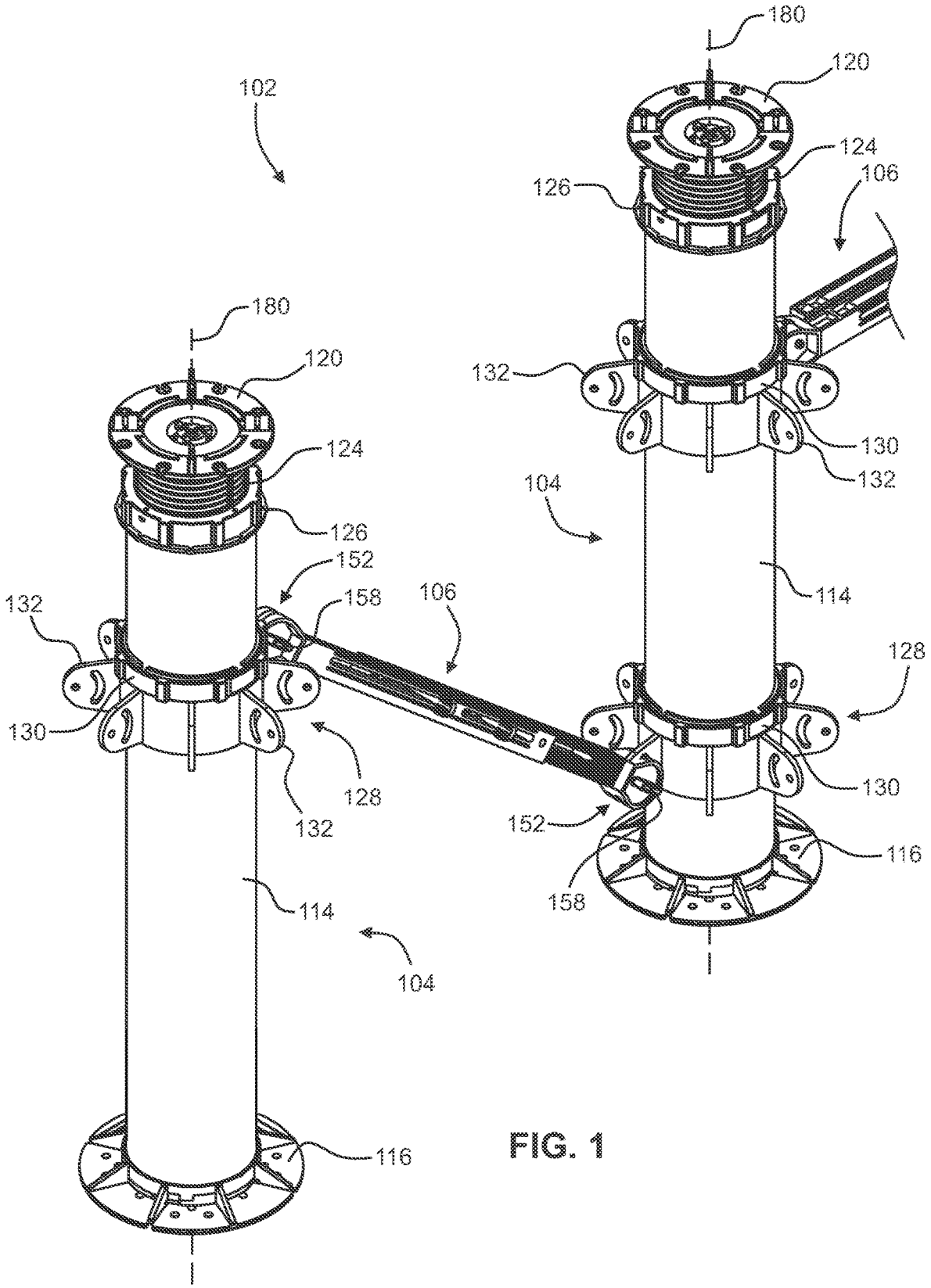
FIG. 1 is a diagrammatic perspective view of one example implementation of a braced pedestal subsystem, wherein the brace elements are attached to the pedestal elements by way of a brace interface element with vertically-oriented attachment fins.

Referring now to the drawings, like reference numerals designate identical or corresponding features throughout the several views.

Referring to the several figures, certain preferred embodiments of a braced flooring tray support system are generally show at 100. The system 100 may comprise one or more tray elements 108 supported by a braced pedestal subsystem 102. Disclosed herein are several example embodiments of such a subsystem 102, including various structural configurations for attaching the brace elements 106 to respective pedestal elements 104.

Figure 2:
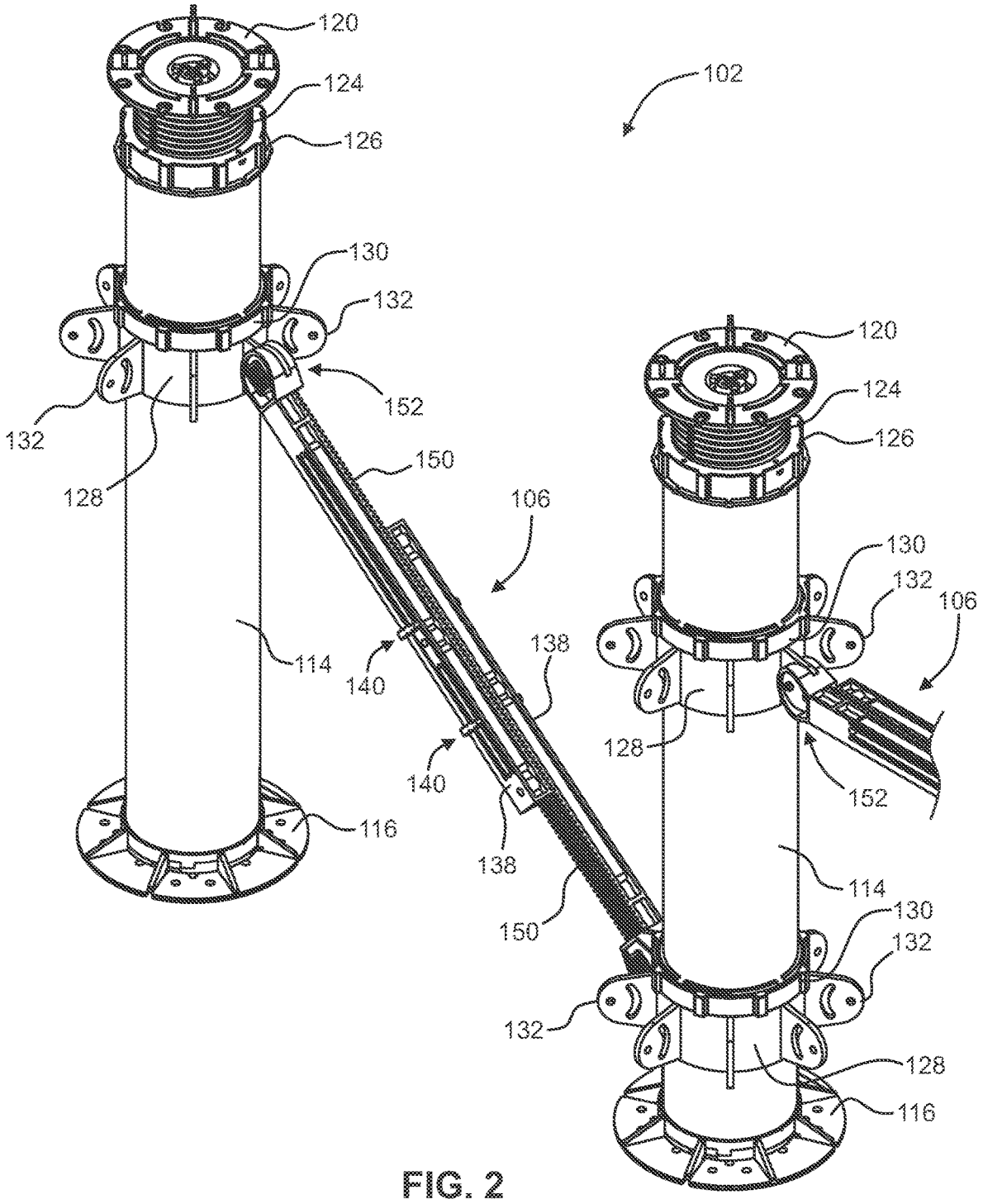
FIG. 2 is a further diagrammatic perspective view of the example subsystem shown in FIG. 1.
Figure 3:
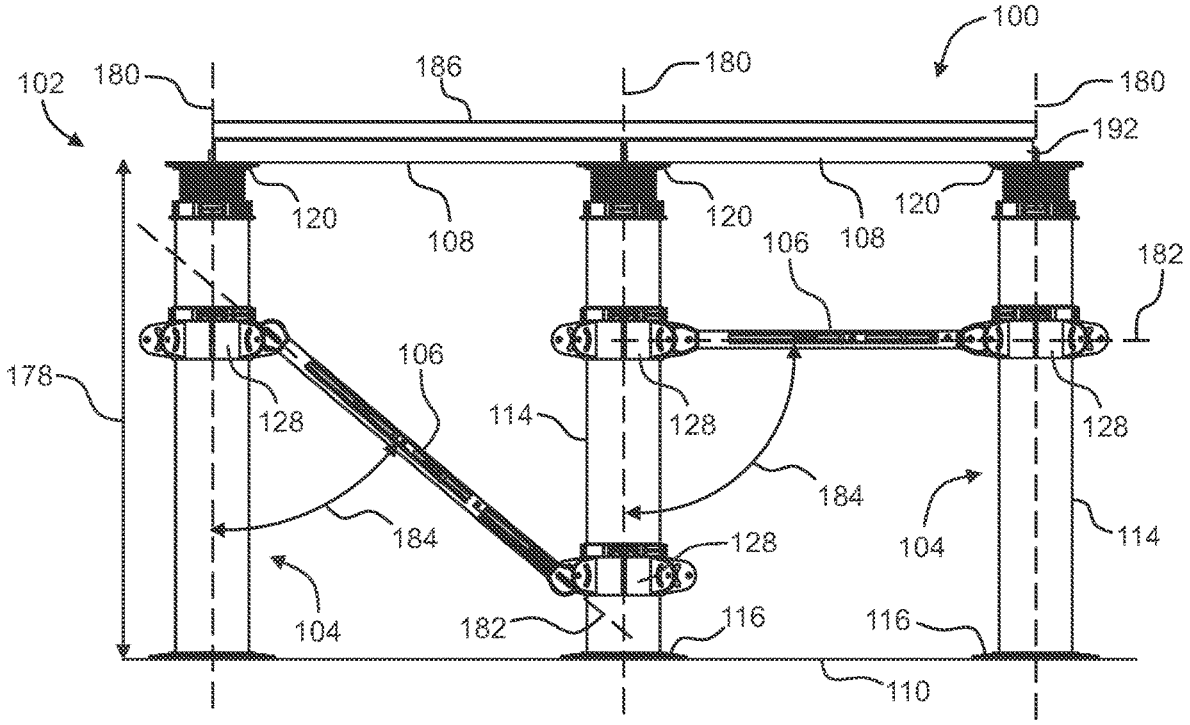
FIG. 3 is a side view of one example implementation of a braced flooring tray support system, wherein the system is shown incorporating a braced pedestal subsystem such as the one shown in FIGS. 1 and 2.
Figure 4:
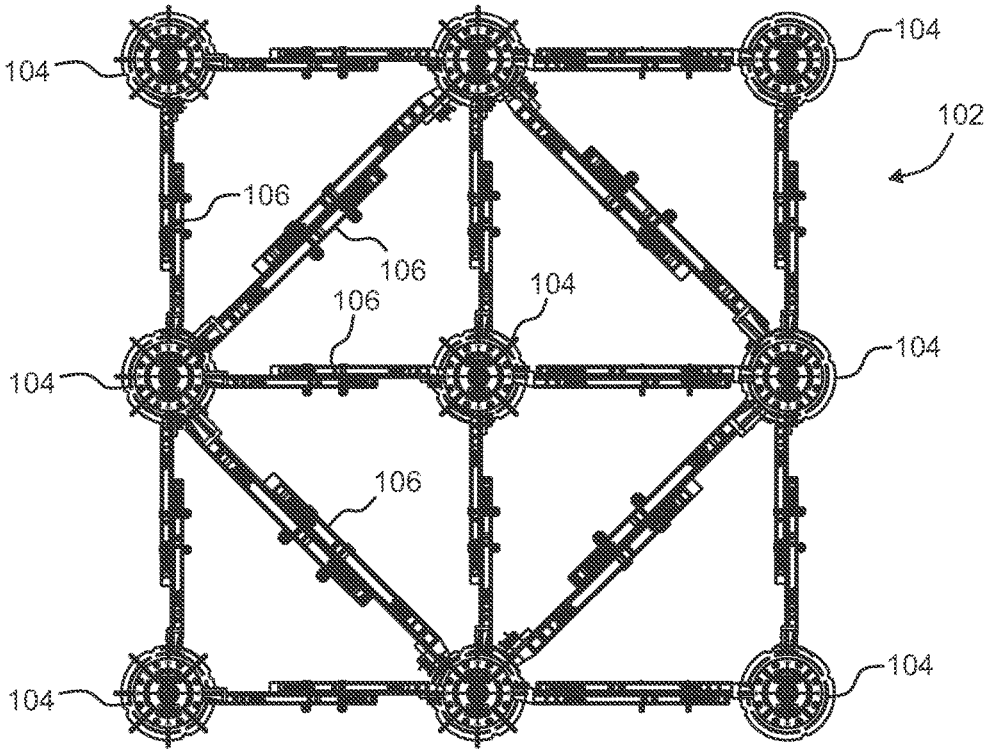
FIG. 4 is a diagrammatic top view of one example braced pedestal subsystem, wherein brace elements are shown extending between respective pedestal elements both orthogonally and in the diagonal.

Referring to FIGS. 1-3, a braced flooring tray support system 100 may comprise a braced pedestal subsystem 102, which may itself include a plurality of pedestal elements 104, a multiplicity of brace elements 106, and one or more tray elements 108. The tray elements 108 may be configured to support deck or flooring elements 186 such as flooring tiles, synthetic turf, or the like. The system 100 may thereby be configured to support the deck or flooring elements 186 at a distance 178 from the local horizontal substrate (e.g., pre-existing ground surface, pre-existing flooring or foundation, or other surrounding native substrate).

Figure 5:
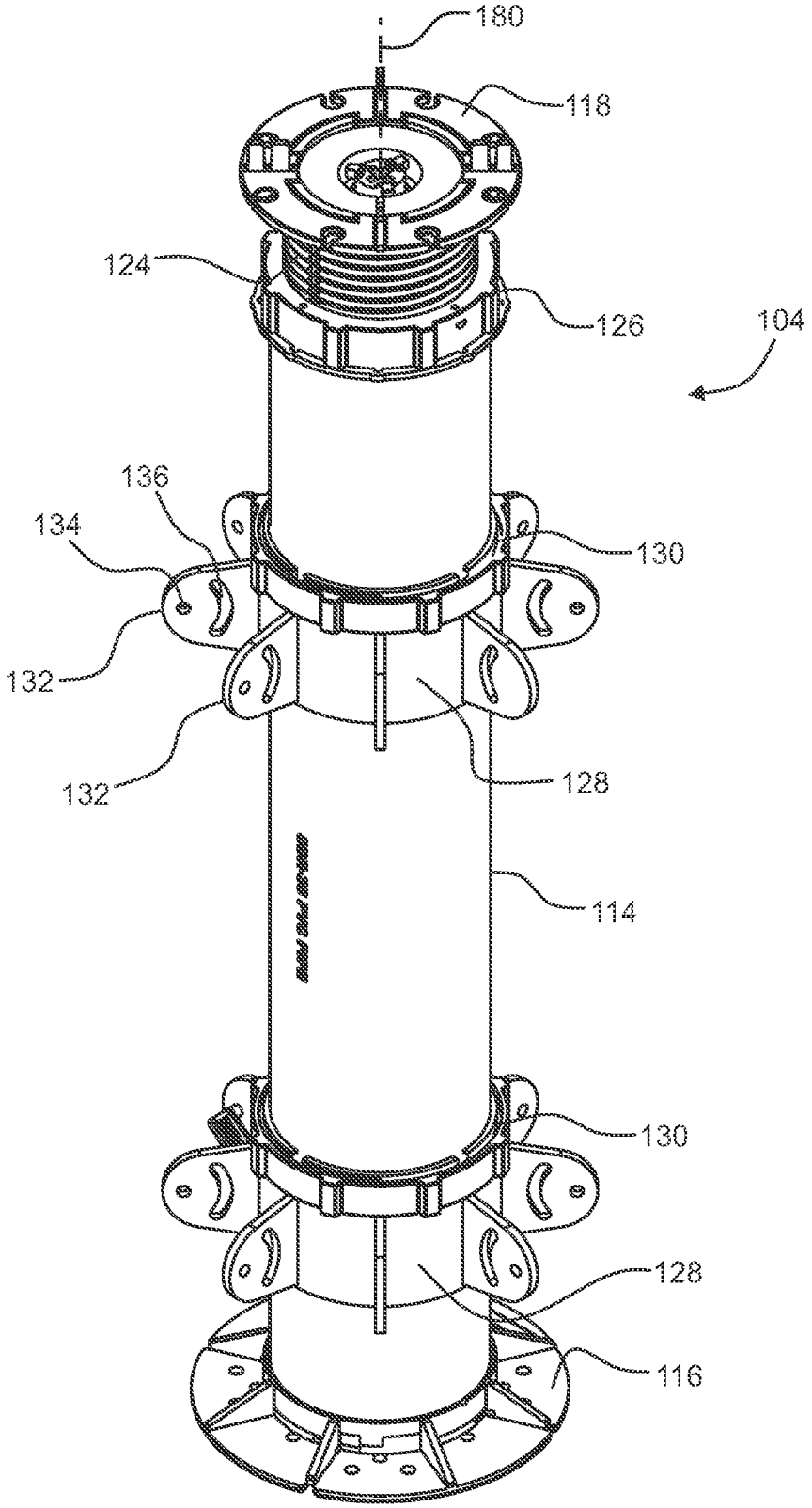
FIG. 5 is a diagrammatic perspective view of one example implementation of a pedestal element, wherein the pedestal elements have two brace interface elements with vertically-oriented attachment fins.

Referring to FIGS. 3 and 5, the pedestal elements 104 may have a base element 116, a tray support element 120 and a pedestal tube 114 extending therebetween along a pedestal axis 180. At least two of the pedestal elements 104 in a braced pedestal subsystem 102 may including a brace interface element 128. The brace interface elements 128 may have a plurality of attachment apertures (such as those shown at 134 and 136).

Referring to FIGS. 6-7 and 15-17, a brace element 106 may have an opposing pair of pedestal interface portions 152 and may extending in length-adjustable fashion therebetween along a respective brace axis 182.

A tray element 108 may have having corners 192. Each corner may be configured to supportedly engage a respective tray support element 120.

Referring to FIGS. 6, 8, 15 and 18, the pedestal interface portions 152 may preferably include a slot 188 configured to engageably receive a brace engagement portion (132, 162) of a brace interface element 128. At least one pin alignment aperture (154, 156) may intersect the slot 188. A corresponding brace fastener element 158 may be configured to be manually installed in and removed from the pedestal interface portion 152. Referring to FIGS. 8, and 20-22, each brace fastener element 158 may including at least one fastener pin 164 configured to extend through a respective pin alignment aperture (156, 156) and a respective attachment aperture (134, 136) when the brace fastener element 158 is installed.

Figure 25:
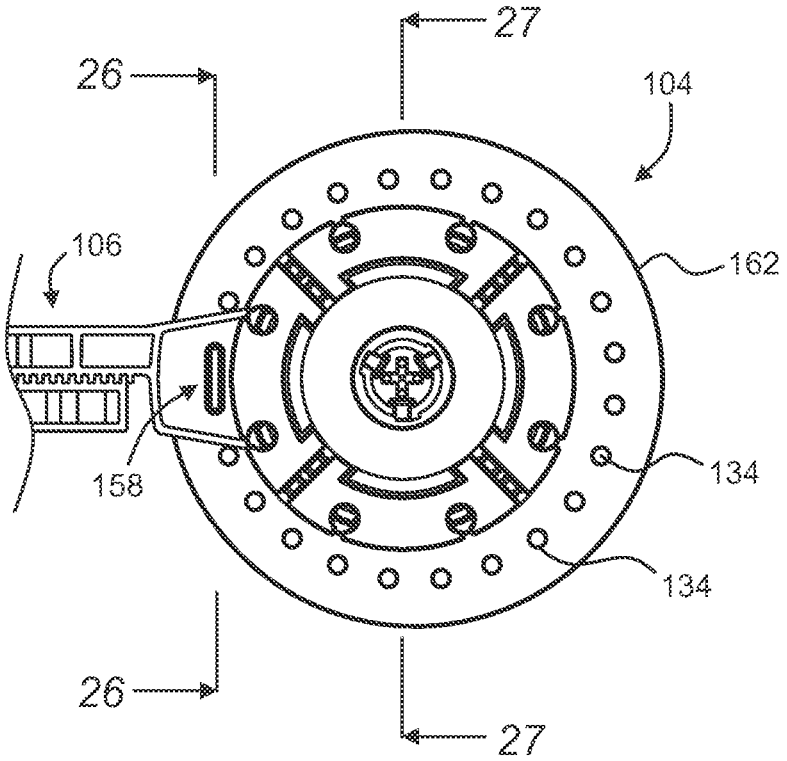
FIG. 25 is a diagrammatic partial top view of the configuration of FIG. 23 and the associated pedestal element.
Figure 26:
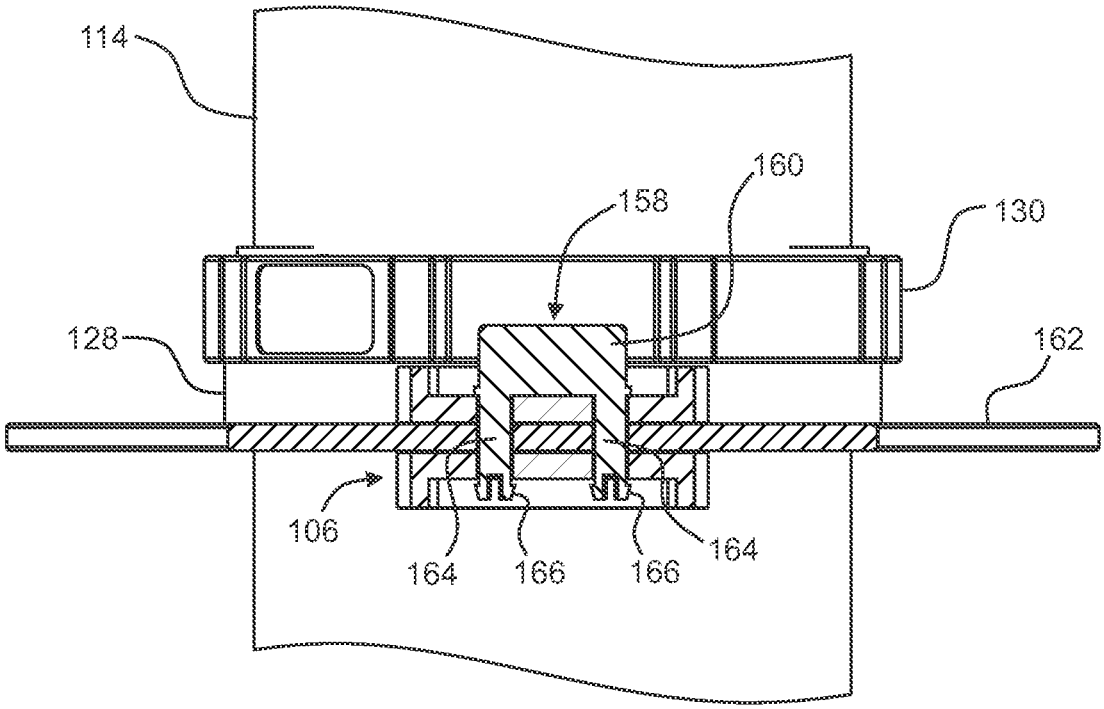
FIG. 26 is a diagrammatic cross-sectional view taken along lines 26-26 of FIG. 25.

Referring to FIGS. 5 and 25, the brace interface elements 128 may include one or more radially-extending brace engagement portions (132, 162) through which the attachment apertures (134, 136) extend.

Figure 6:
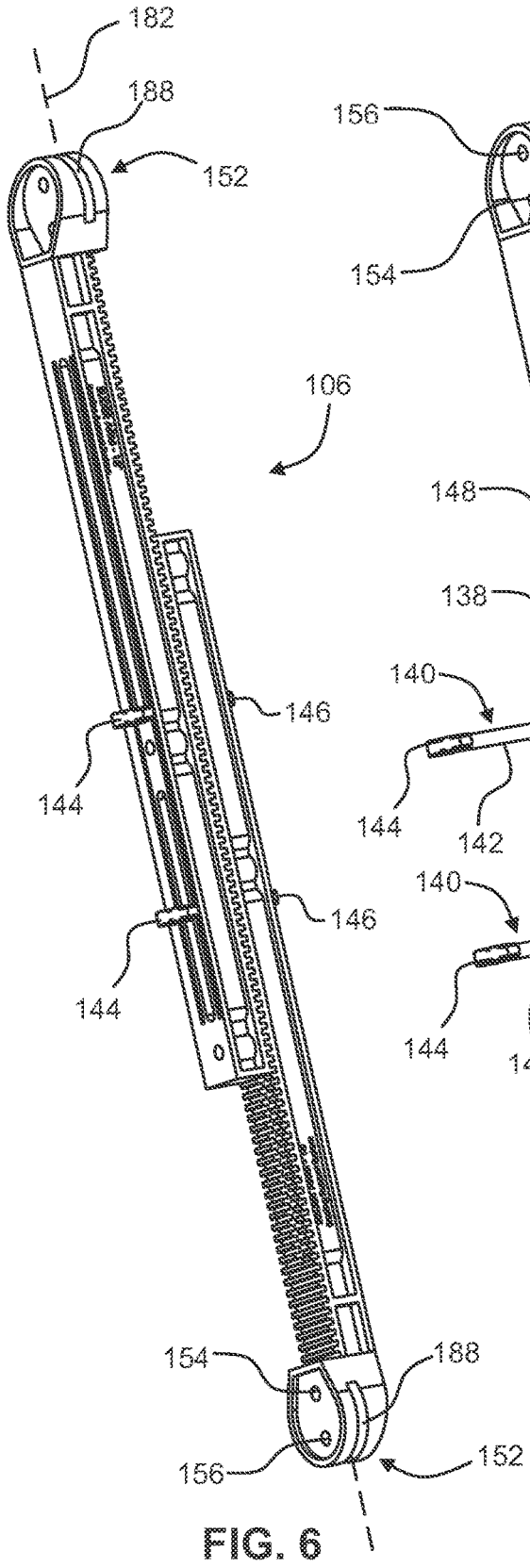
FIG. 6 is a diagrammatic perspective view of one example implementation of a brace element, such as one that would be used within the braced pedestal subsystems shown in FIGS. 1-4.
Figure 7:
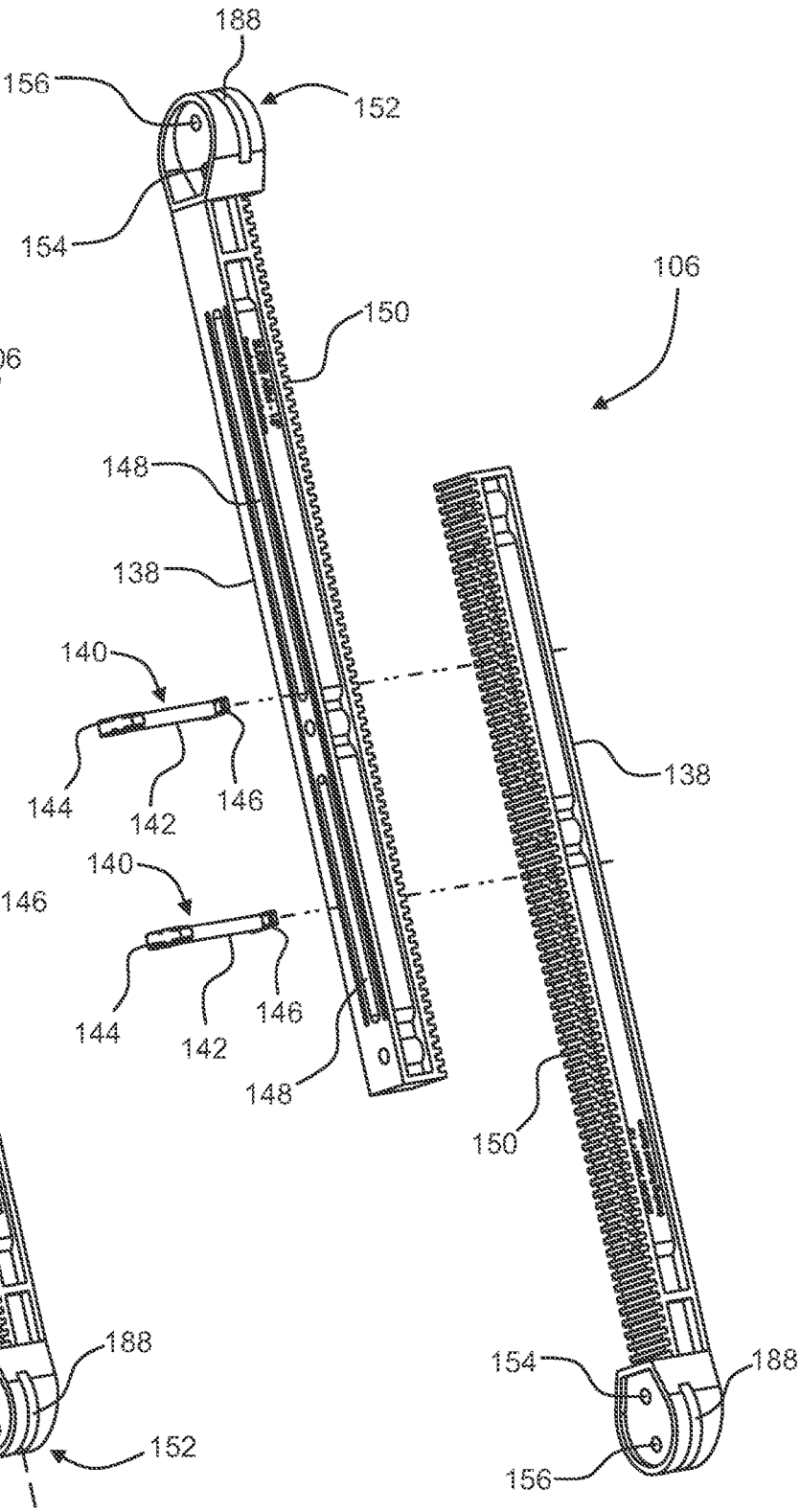
FIG. 7 is a diagrammatic exploded view of the example brace element of FIG. 6.
Figure 17:
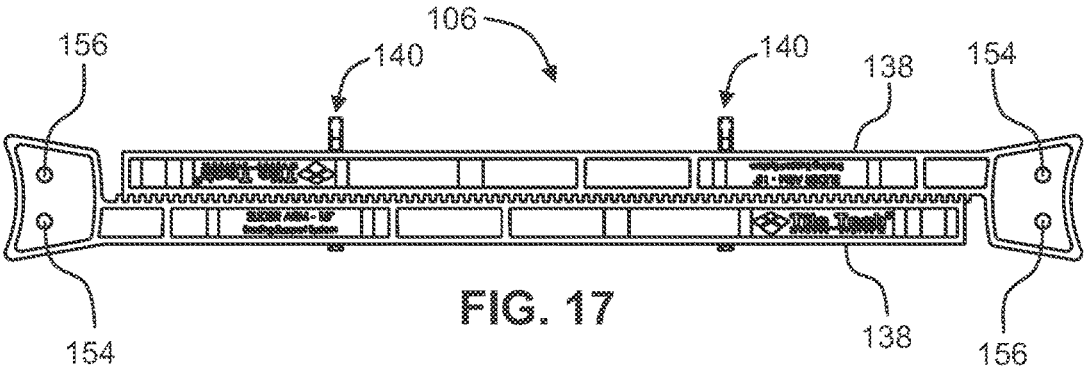
FIG. 17 is a diagrammatic top view of the example brace element of FIG. 15.
Figure 18:
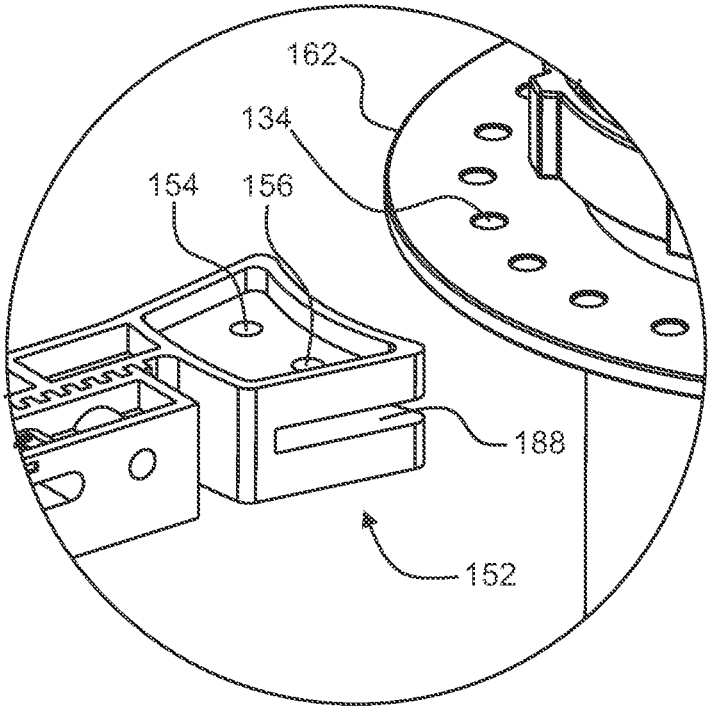
FIG. 18 is a diagrammatic partial perspective view showing a flange interface portion of a brace element disassembled from a respective attachment flange of a pedestal element.
Figure 19:
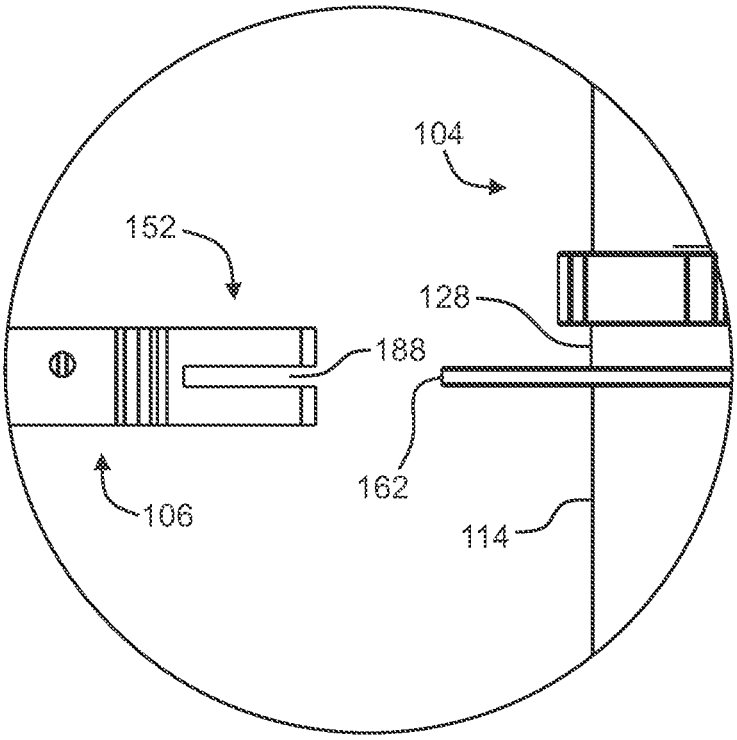
FIG. 19 is a diagrammatic partial side view of the configuration of FIG. 18.

Referring to FIGS. 6 and 17, each pedestal interface portion 152 may include a first pin alignment aperture 154 and a second pin alignment aperture 156. In particular implementations of a pedestal interface portion 152, the slot 188 may be planar, and the pin alignment apertures (154, 156) extend perpendicularly to the slots.

Referring to FIGS. 8, 9, 21 and 23, the brace fastener elements 158 may be entirely removable and replaceable (non-destructibly) with respect to the pedestal interface portions 152 and brace interface elements 128.

Figure 20:
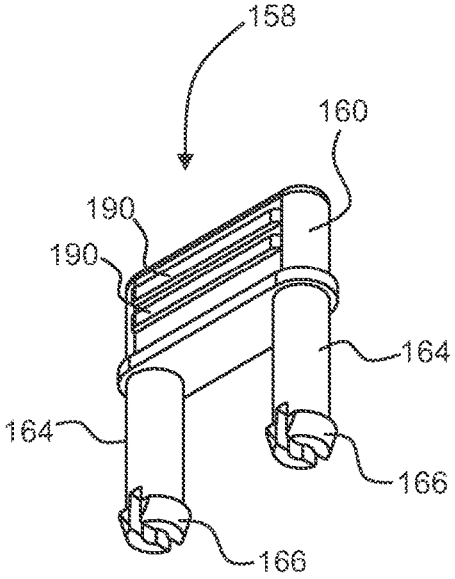
FIG. 20 is a diagrammatic perspective view of one example brace fastener element.
Figure 22:
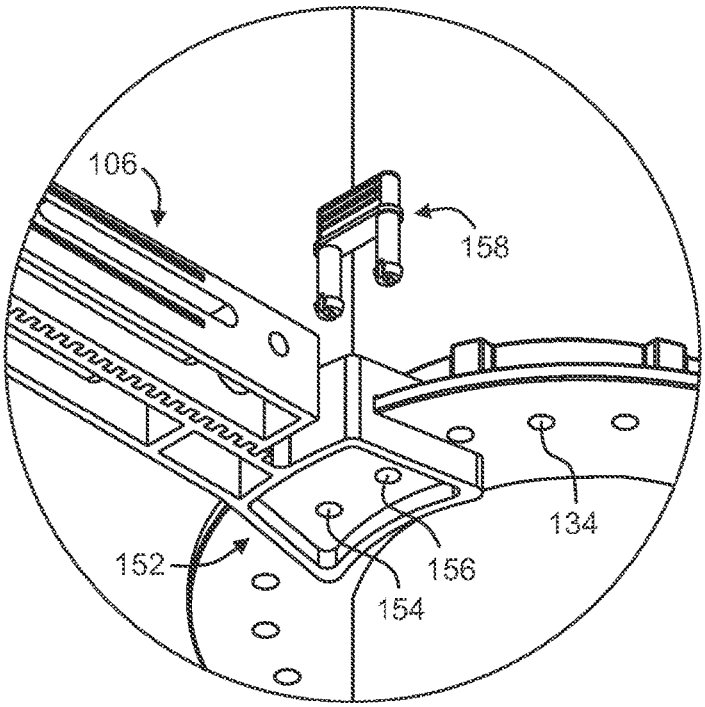
FIG. 22 is a further diagrammatic partial perspective view of the configuration of FIG. 21, but from a low-angle viewpoint.
Figure 23:
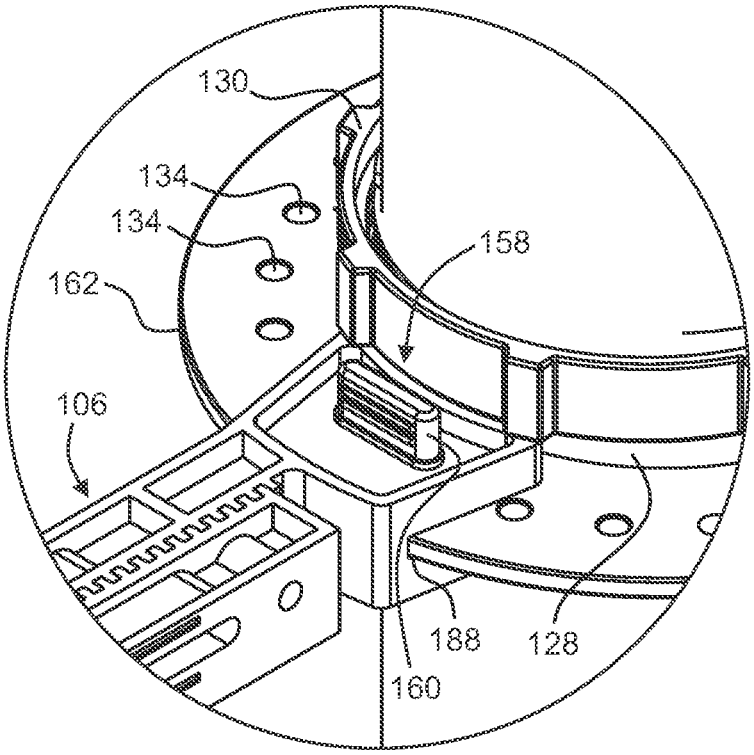
FIG. 23 is a diagrammatic partial perspective view similar to that of FIG. 21, but wherein the brace fastener element has been inserted through the respective pin alignment apertures of the brace element and the respective attachment apertures in the attachment flange.
Figure 24:
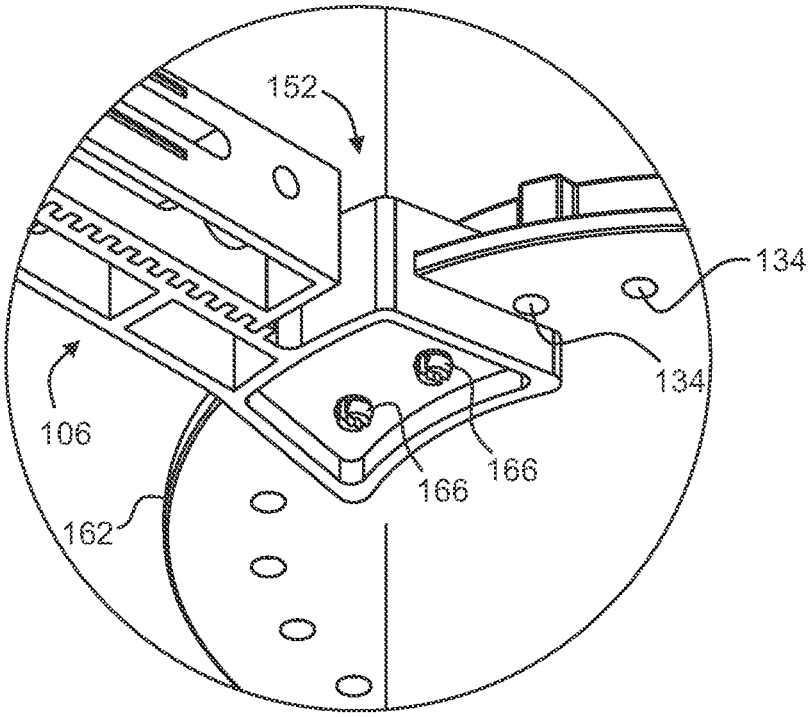
FIG. 24 is a further diagrammatic partial perspective view of the configuration of FIG. 23, but from a low-angle viewpoint showing detent portions of the fastener pins configured to retain the brace fastener element in place.

Referring to FIG. 20, the fastener pins 164 may include a detent portion 166 configured to releasably secure the installation of the brace fastener element 158 without requiring any threaded engagement (i.e., no threaded engagement required between the pin 164 and some other component, like a threaded nut). Depending upon the particular embodiment of the system 100, the detent portion 166 may be, for example, a snap feature (see, for example, FIGS. 20 and 24), or a cotter pin, c-clip, or the like.

Figure 8:
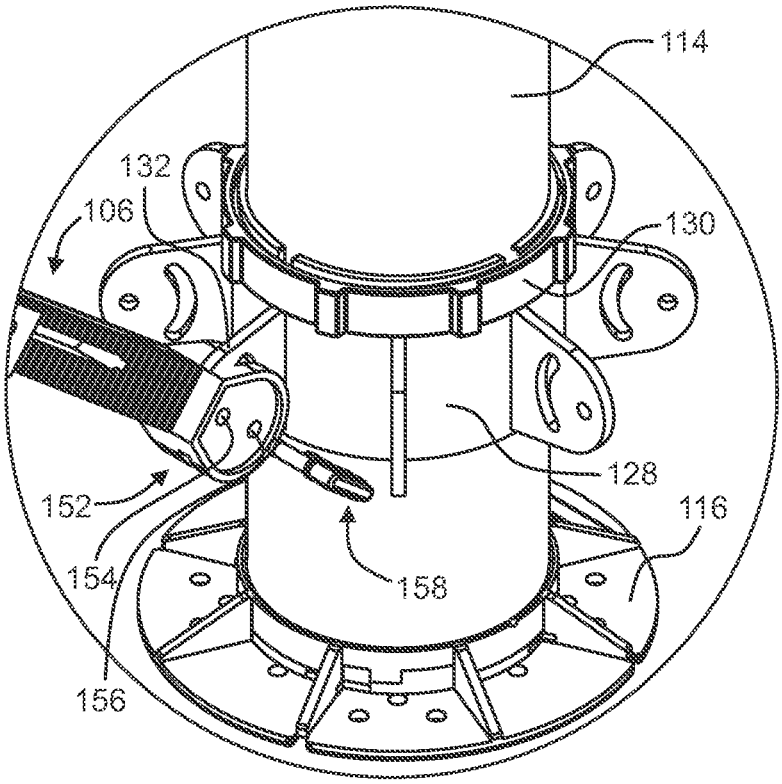
FIG. 8 is a diagrammatic partial perspective view of a portion of FIG. 1, wherein the respective brace fastener element is shown in the process of being inserted through the pin alignment apertures of the brace element and the corresponding attachment apertures of the brace interface element.
Figure 9:
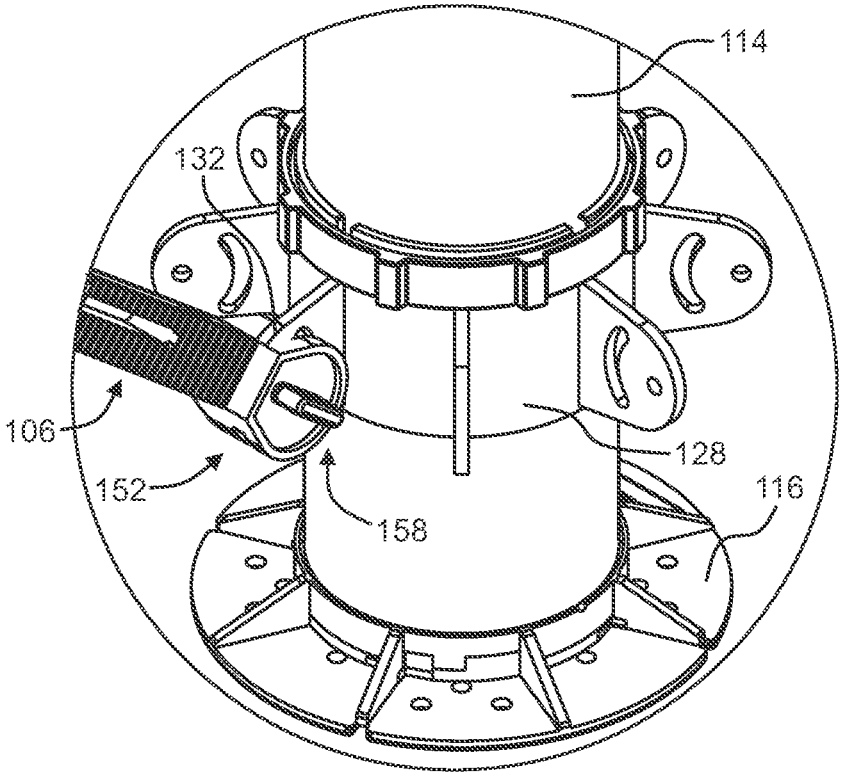
FIG. 9 is a diagrammatic partial perspective view similar to that of FIG. 8, but wherein the brace fastener element is shown fully inserted through the pin alignment apertures of the brace element and the corresponding attachment apertures of the brace interface element.
Figure 10:
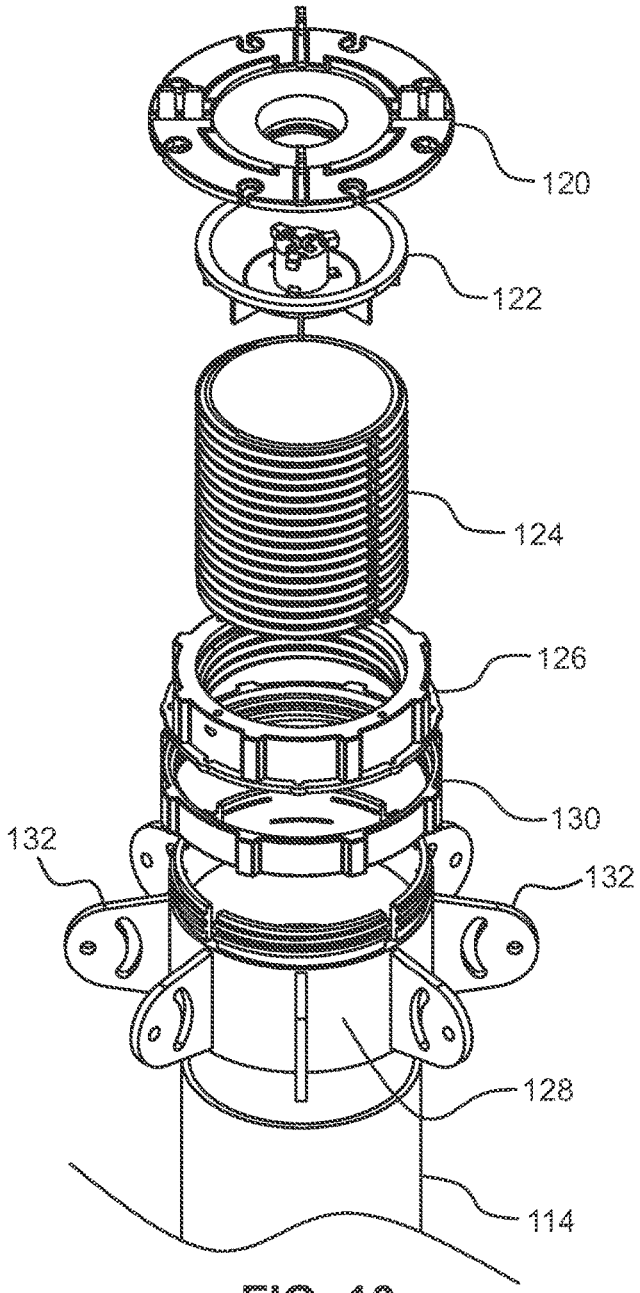
FIG. 10 is a diagrammatic partial exploded view the example pedestal element of FIG. 5.
Figure 11:
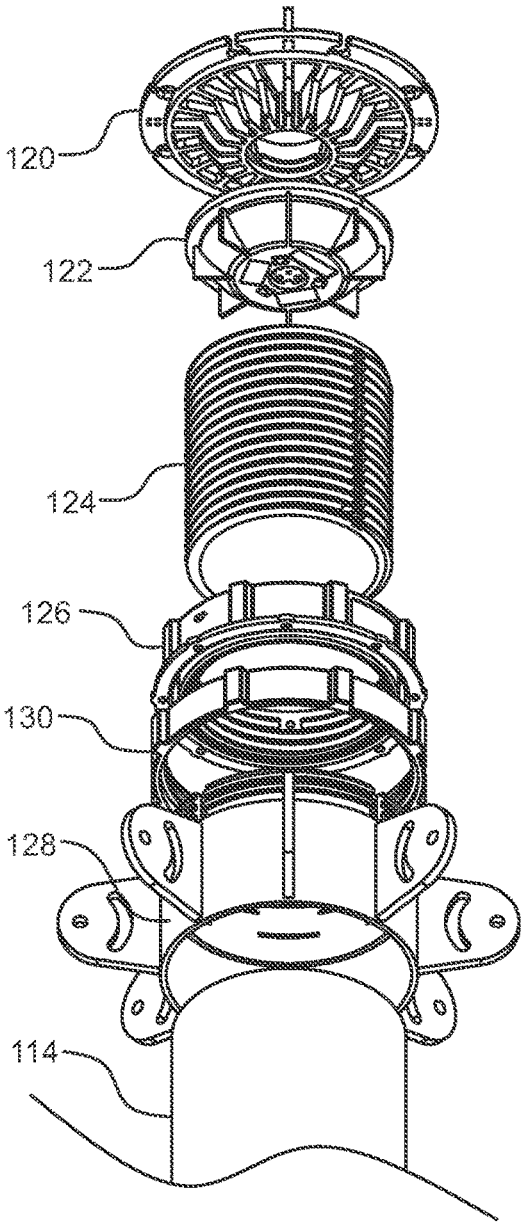
FIG. 11 is a diagrammatic partial exploded view similar to that of FIG. 10, but from a low-angle viewpoint.
Figure 12:
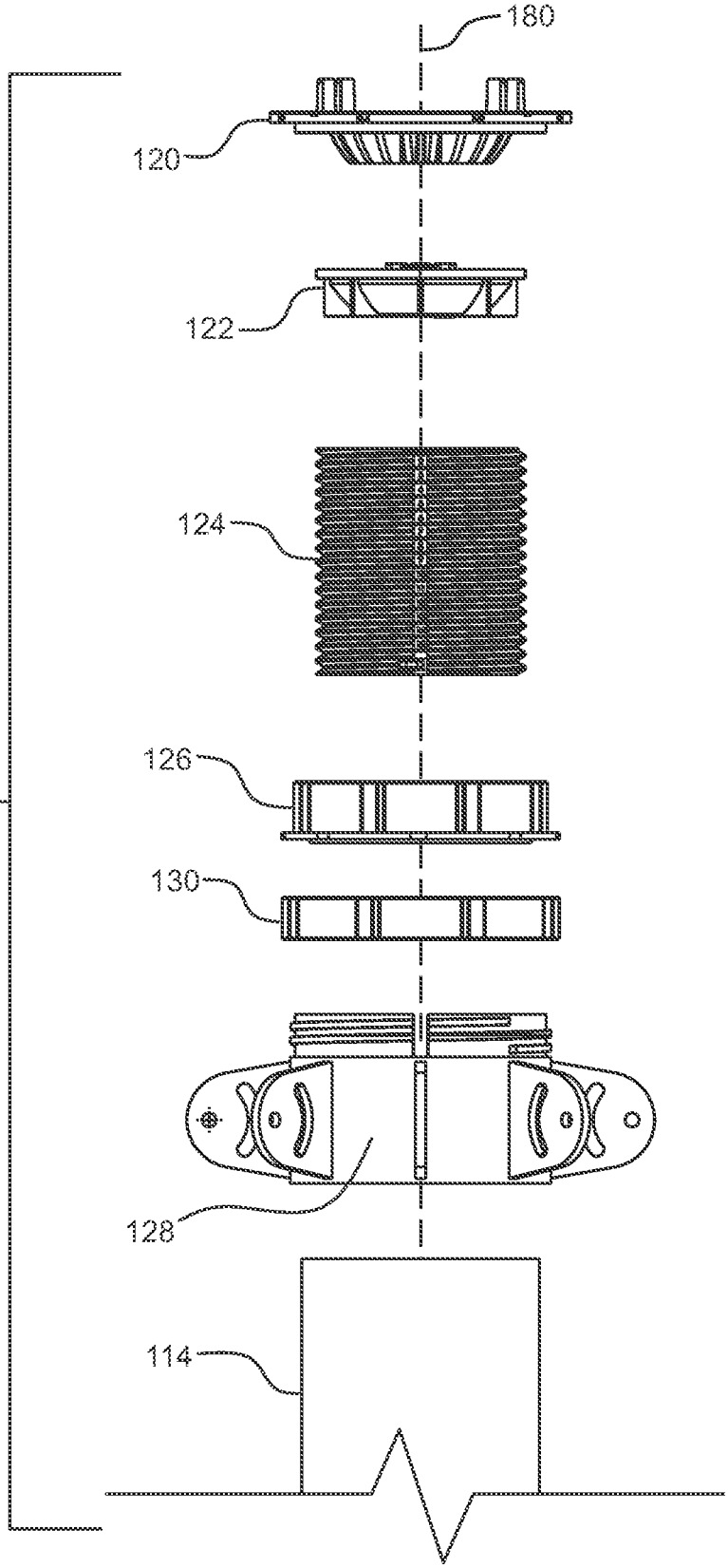
FIG. 12 is a diagrammatic partial exploded view similar to that of FIG. 10, but from a side viewpoint.
Figure 13:
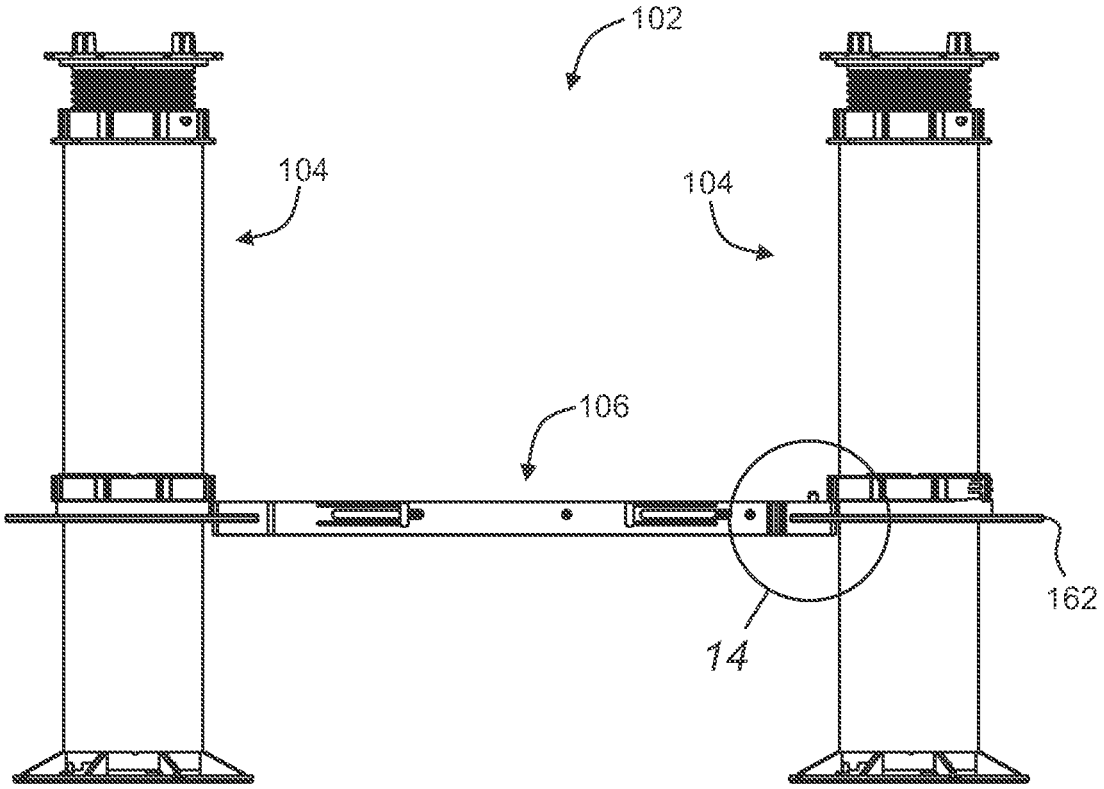
FIG. 13 is a diagrammatic side view of another example implementation of a braced pedestal subsystem, wherein the brace elements are attached to the pedestal elements by way of a brace interface element with an attachment flange.
Figure 14:
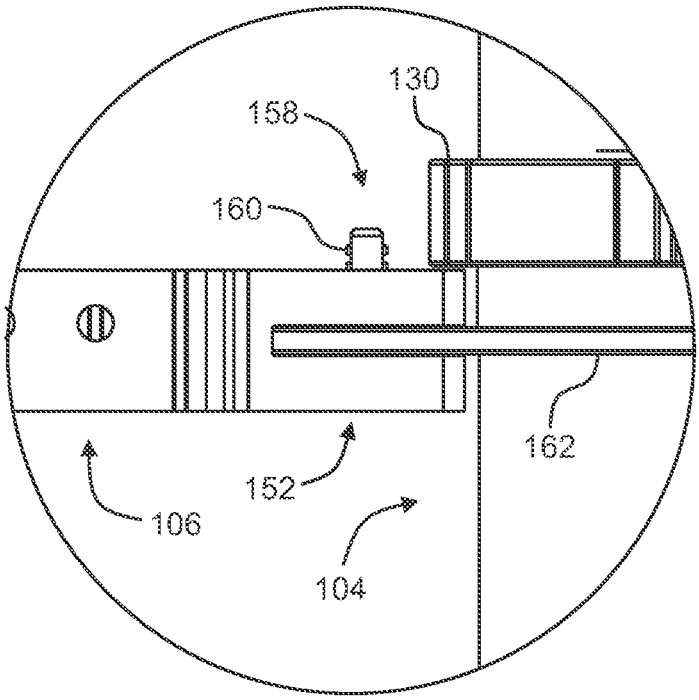
FIG. 14 is a diagrammatic magnified view of detail 14 in FIG. 13.
Figure 15:
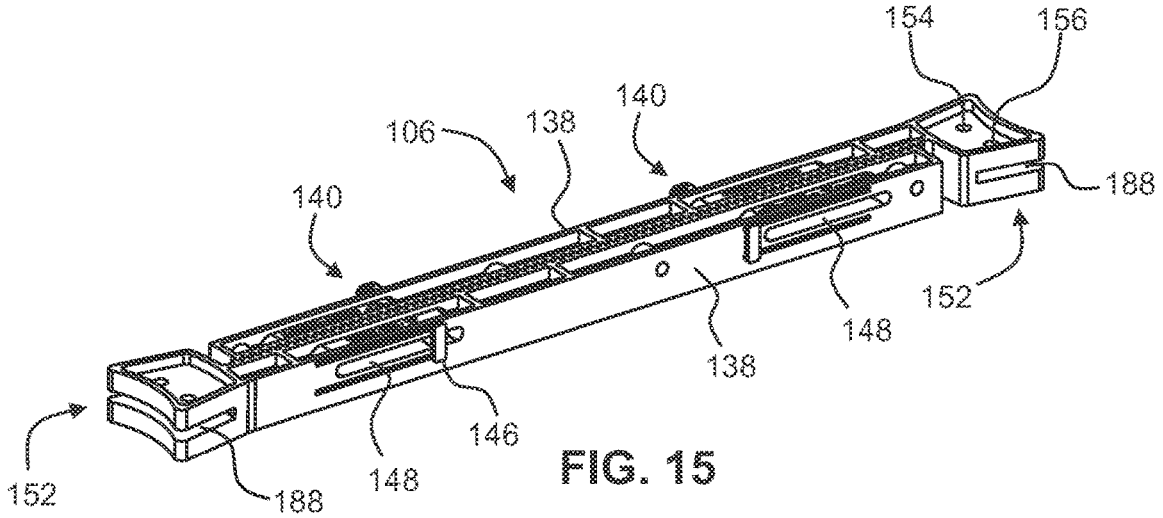
FIG. 15 is a diagrammatic perspective view of another example implementation of a brace element, such as one that would be used within the braced pedestal subsystem shown in FIG. 13.
Figure 16:
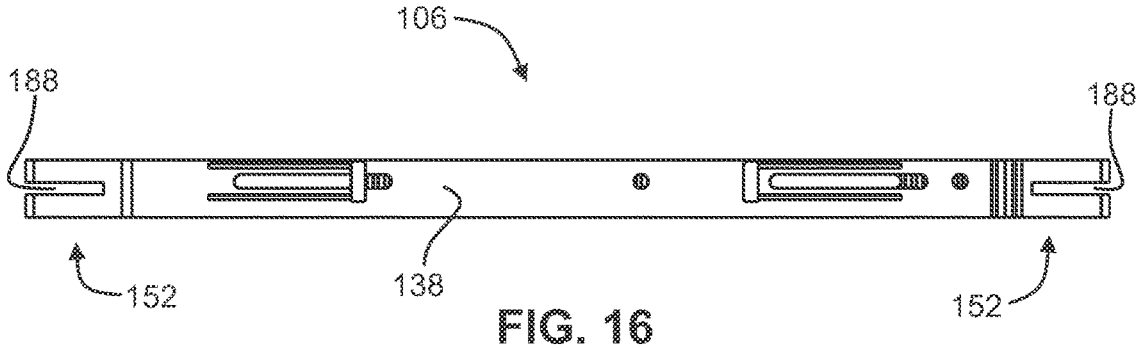
FIG. 16 is a diagrammatic side view of the example brace element of FIG. 15.

Referring to FIGS. 5 and 8, in particular importations of a system 100, the brace engagement portions may be in the form of a vertical fin 132. In such case, each vertical fin 132 may include a first attachment aperture 134 and a second attachment aperture 136 configured to respectively align with the first pin alignment aperture 154 and second pin alignment aperture 156 of a respective pedestal interface portion 152 when the slot 188 of the respective pedestal interface portion 152 is in receipt of the vertical fin 132. Further, in such embodiments, each brace interface element 128 may include a plurality of brace engagement portions 132 distributed circumferentially about the brace interface element 128 (see, for example, FIGS. 5 and 10). Moreover, the first attachment aperture 134 or the second attachment aperture 136 may be arcuate. For example, FIG. 5 illustrates a case in which the second attachment aperture 136 is arcuate.

Figure 36:
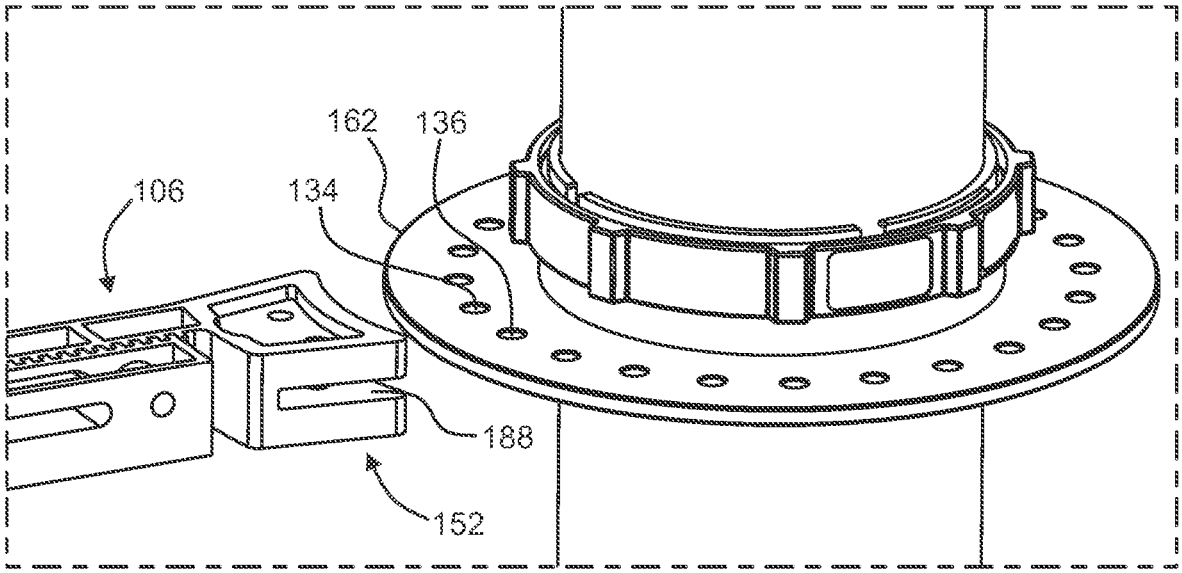
FIG. 36 is a diagrammatic partial perspective view showing a flange interface portion of another example brace element disassembled from a respective attachment flange of a pedestal element.
Figure 37:
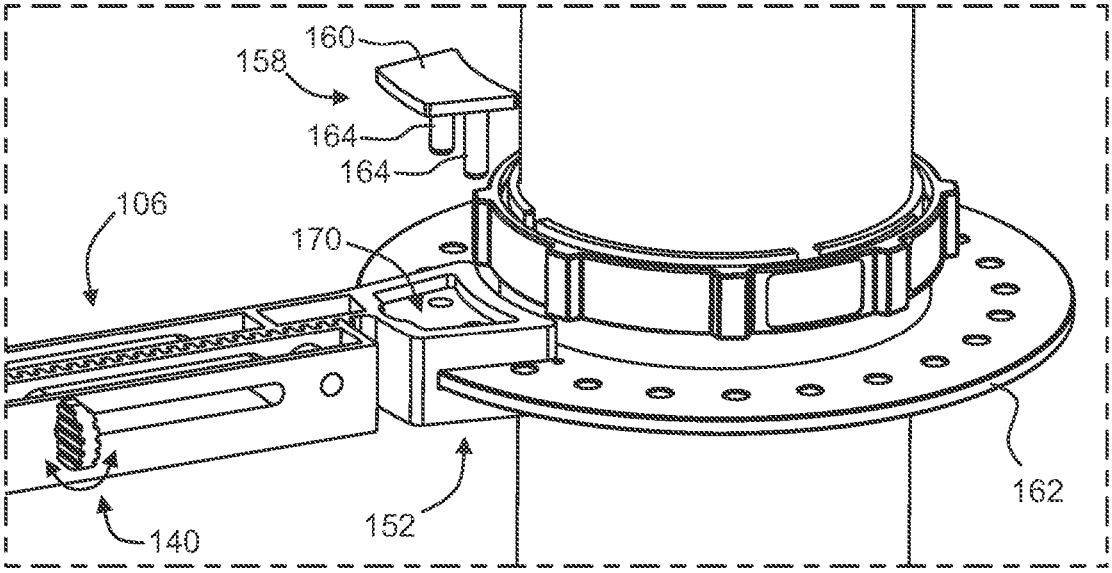
FIG. 37 is a diagrammatic partial perspective view similar to that of FIG. 36, but wherein the flange interface portion of the brace element has been brought into receiving engagement with the attachment flange of the pedestal element.
Figure 38:
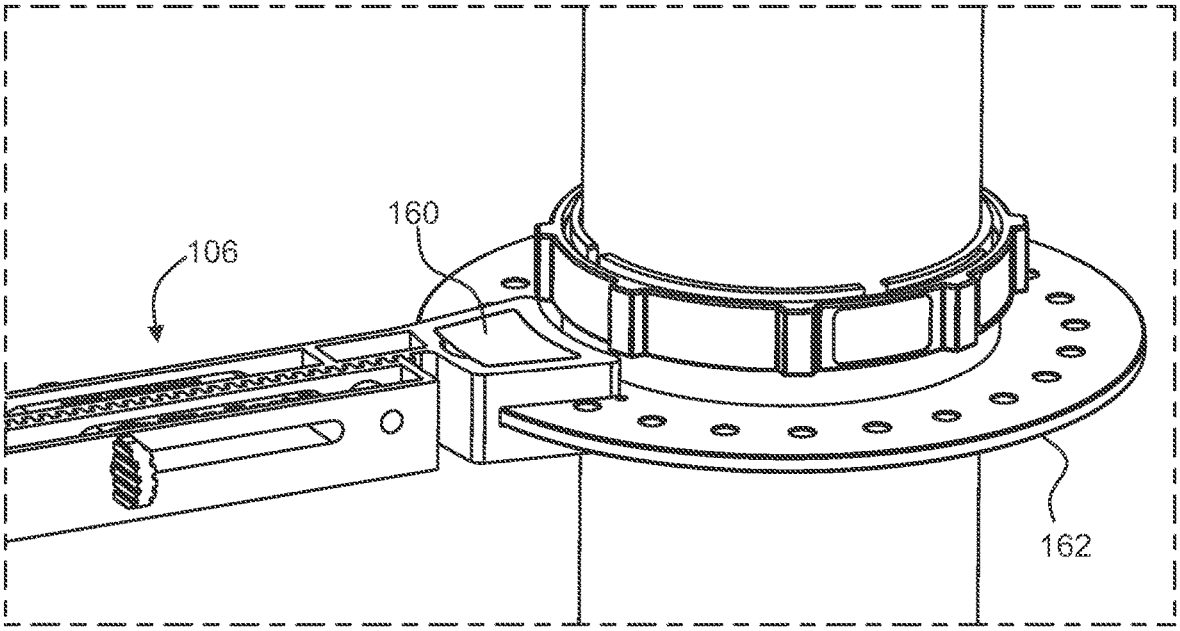
FIG. 38 is a diagrammatic partial perspective view similar to that of FIG. 37, but wherein the brace fastener element has been inserted through the respective pin alignment apertures of the brace element and the respective attachment apertures in the attachment flange, and the fastener head connecting the fastener pins is in engagement with the fastener head recess of the brace element in order to retain the brace fastener element in place.
Figure 39:
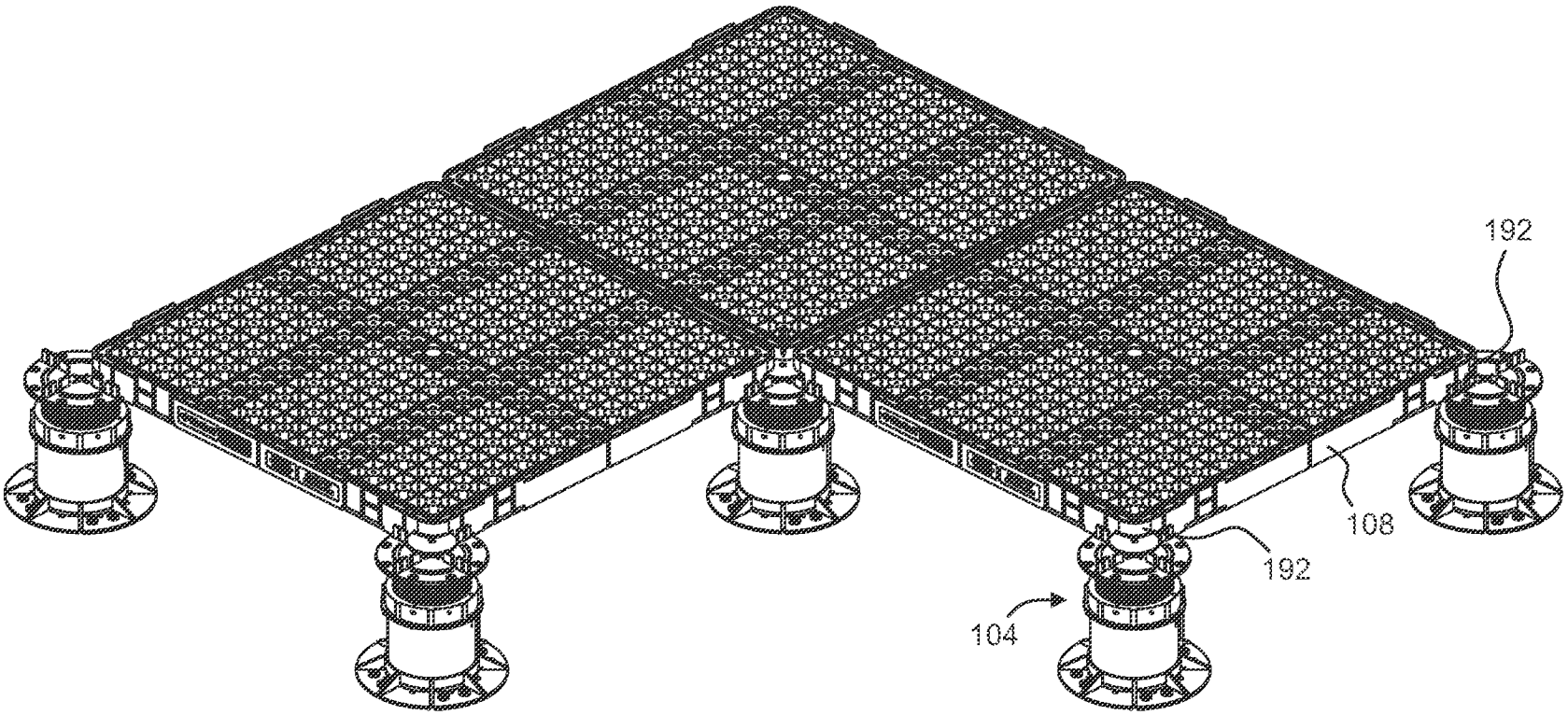
FIG. 39 is a diagrammatic perspective view of an example of a system in which a series of pedestals is arranged to support a series of trays.
Figure 40:
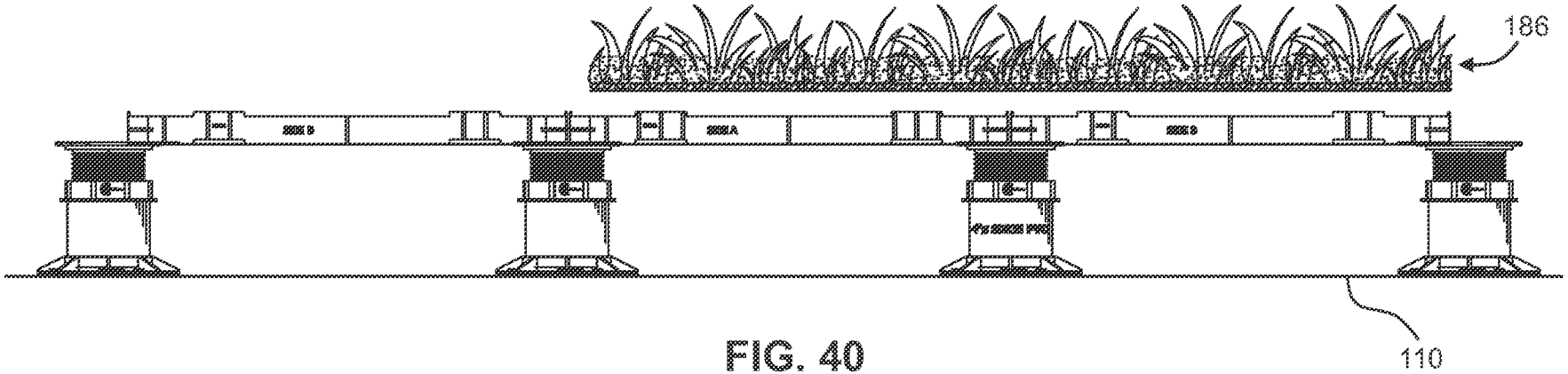
FIG. 40 is a diagrammatic side view illustrating how artificial turf may be affixed to the upper surface of trays supported by a series of pedestals.
Figure 41:
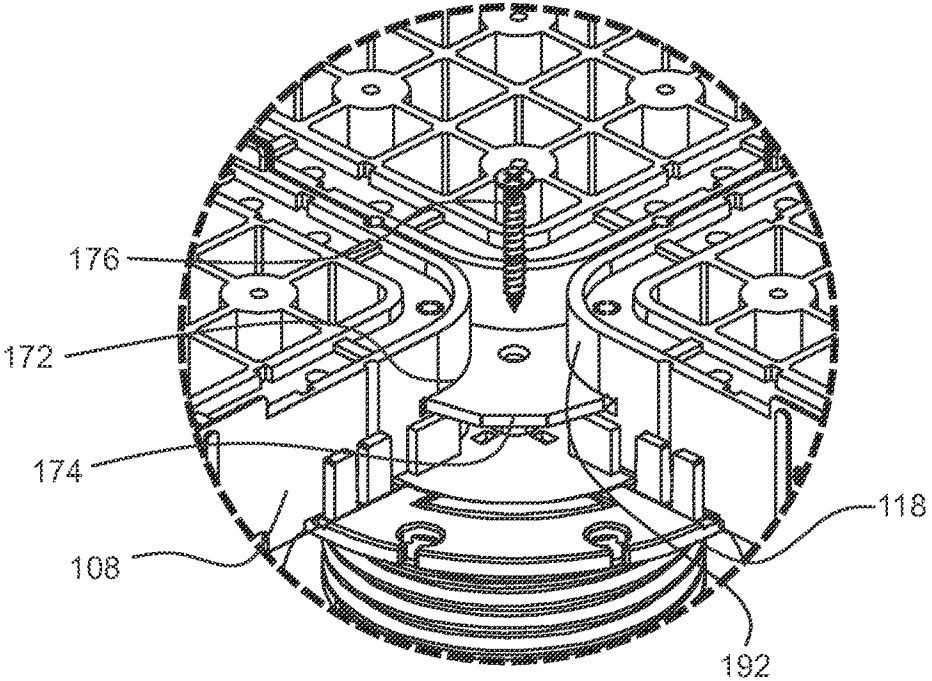
FIG. 41 is a diagrammatic partial perspective view illustrating one example of how the corners of trays may be secured to pedestals.
Figure 42:
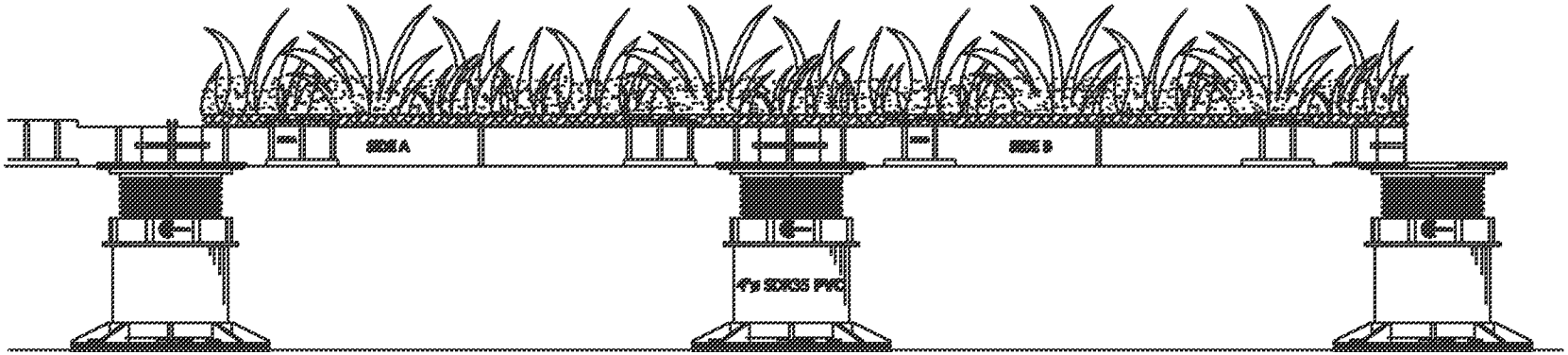
FIG. 42 is a further diagrammatic side view illustrating how artificial turf may be affixed to the upper surface of trays supported by a series of pedestals.

Referring to FIGS. 20 and 37, a brace fastener element 158 may include a fastener head 160 and a pair of fastener pins 164 attached thereto. Referring to FIG. 20, the fastener head 160 may include grip features 190 such as knurling, laterally-extending longitudinal bosses, or the like (e.g., to induce friction between the fastener head 160 and the hand of an installer who is disassembling the system 100). Additionally, or in the alternative, referring to FIGS. 36-38, the fastener head 160 may be configured to be removably press-fit into a fastener head recess 170 within a pedestal interface portion 152 for retaining the respective fastener pins 164 within their pin alignment apertures (154, 156) and attachment apertures (134, 136).

Figure 27:
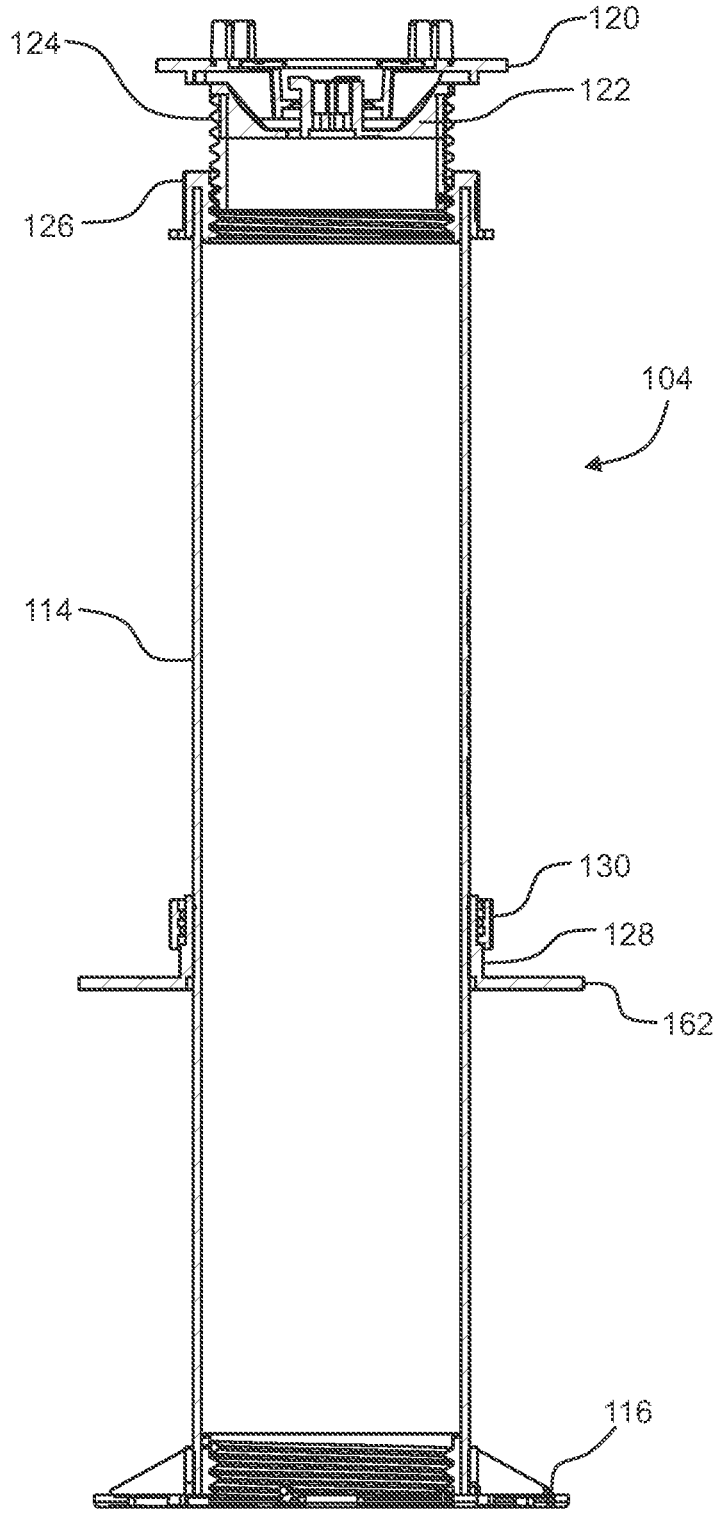
FIG. 27 is a diagrammatic perspective view of a pedestal element taken along lines 27-27 of FIG. 25.

Referring to FIGS. 3 and 27, the brace interface elements 128 may preferably be axially positionally adjustable along the respective pedestal tube 114. This may be accomplished by threadedly rotating a brace interface securement ring 130 in a loosening direction with respect to the brace interface element 128, thereby loosing the circumferential grip of the brace interface element 128 on the pedestal tube 114. Once the brace interface element 128 is moved axially to its desired vertical position on the tube 114, the brace interface securement ring 130 may be rotated in a tightening direction with respect to the brace interface element 128, thereby tightening the circumferential grip of the brace interface element 128 on the pedestal tube 114.

Figure 21:
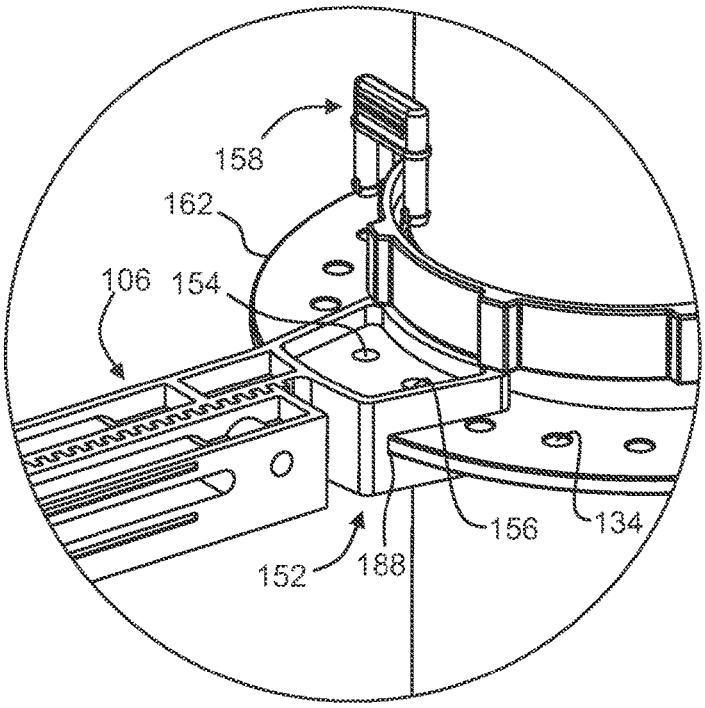
FIG. 21 is a diagrammatic partial perspective view similar to that of FIG. 18, but wherein the flange interface portion of the brace element has been brought into receiving engagement with the attachment flange of the pedestal element.
Figure 28:
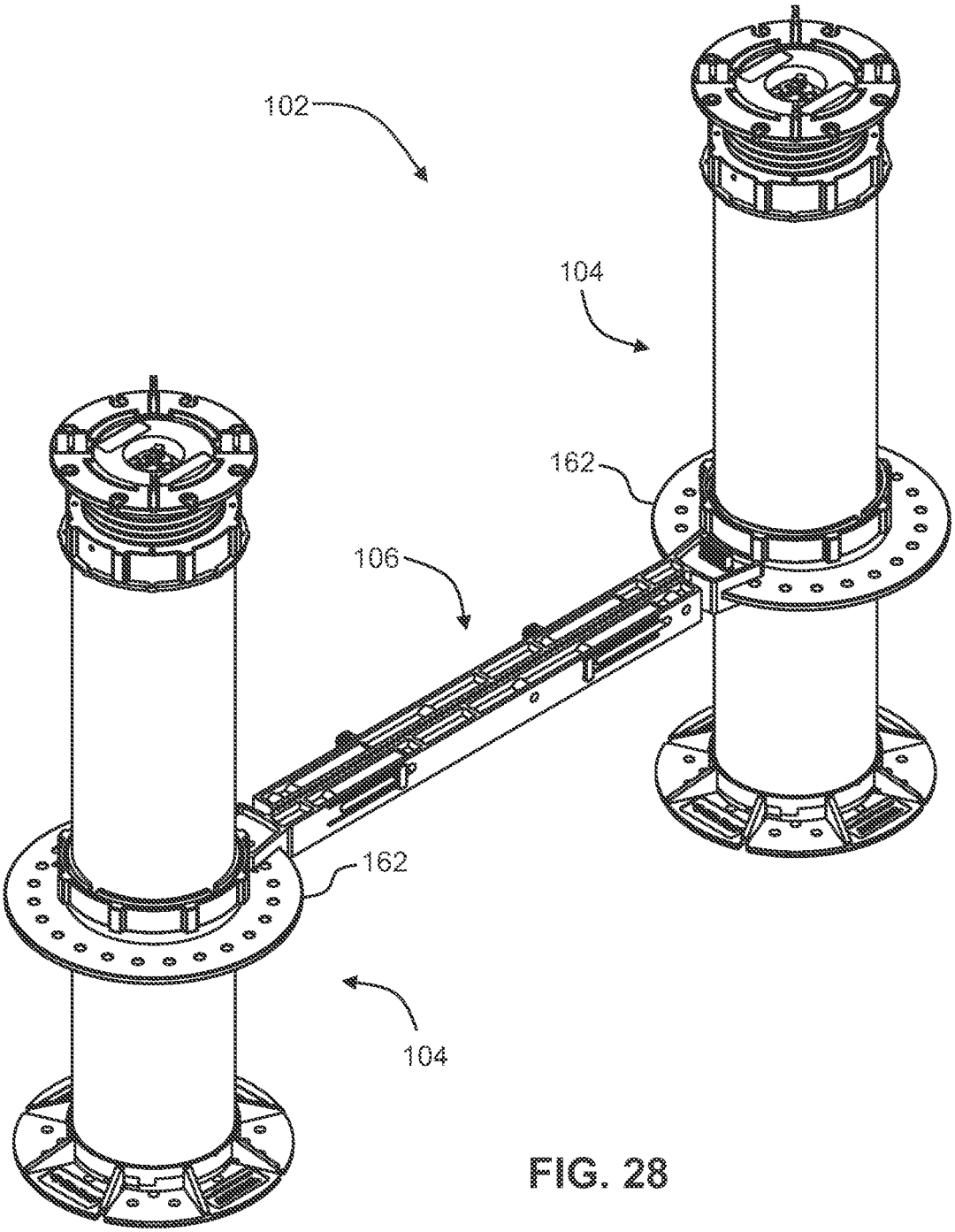
FIG. 28 is a diagrammatic perspective view of the example braced pedestal subsystem shown in FIG. 13.
Figure 29:
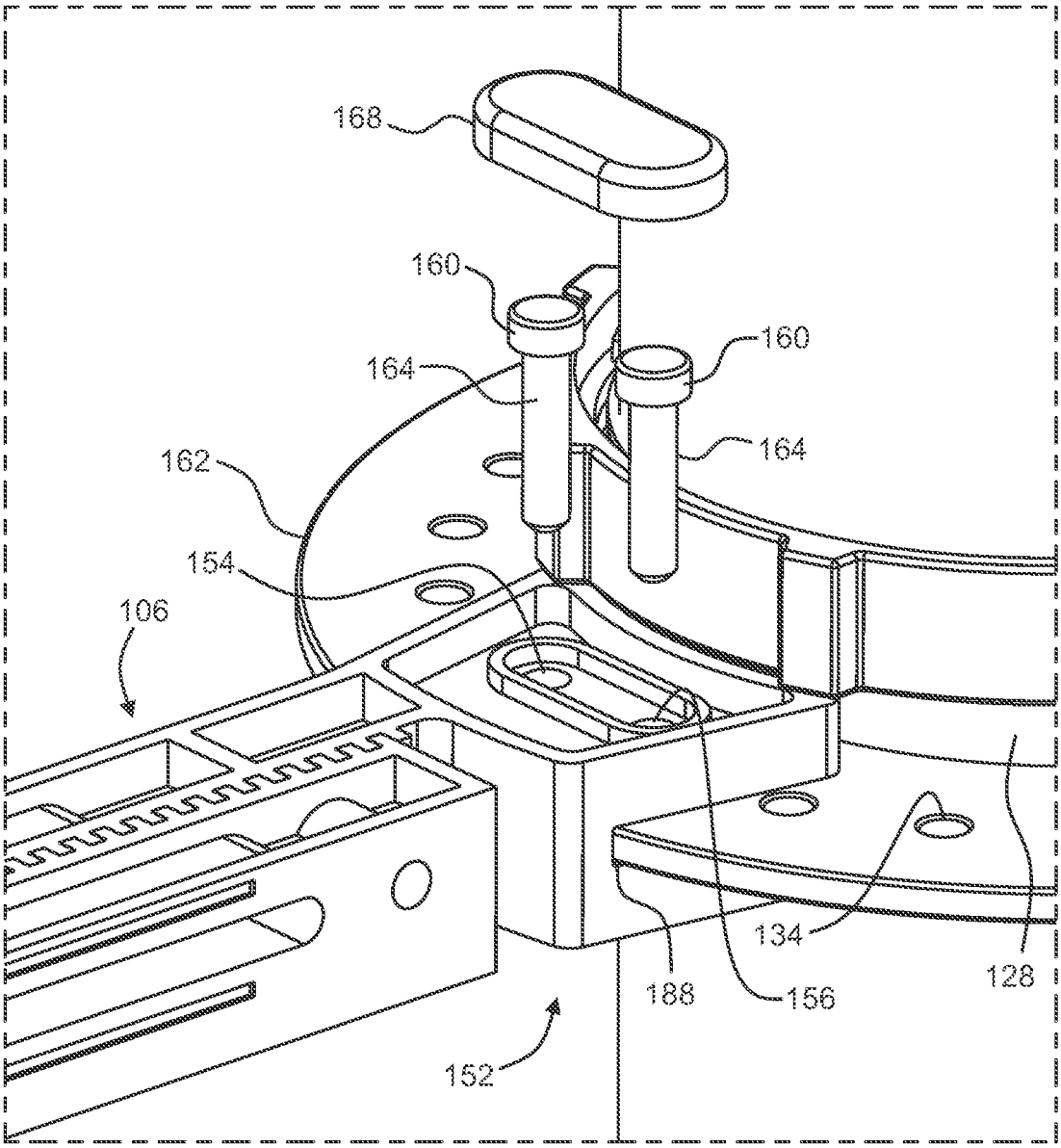
FIG. 29 is a diagrammatic partial perspective view of yet another example braced pedestal subsystem similar to that of FIG. 13, but wherein the brace fastener element is comprised of a non-unitary pair of fastener pins configured to be secured in place by a separate fastener retention cap.
Figure 30:
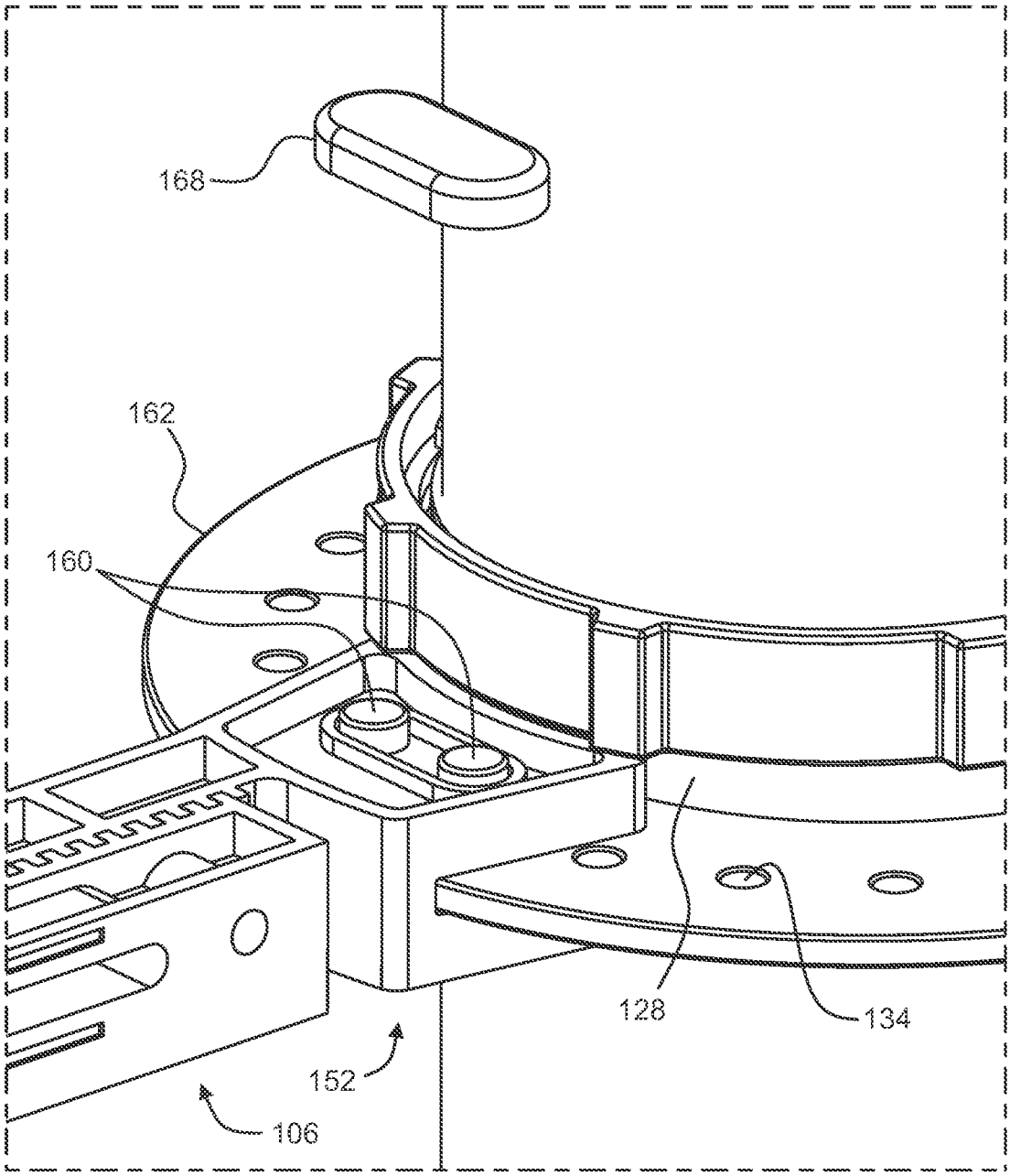
FIG. 30 is a diagrammatic partial perspective view similar to that of FIG. 29, but showing the pair of fastener pins inserted through the respective pin alignment apertures of the brace element and the respective attachment apertures in the attachment flange.
Figure 31:
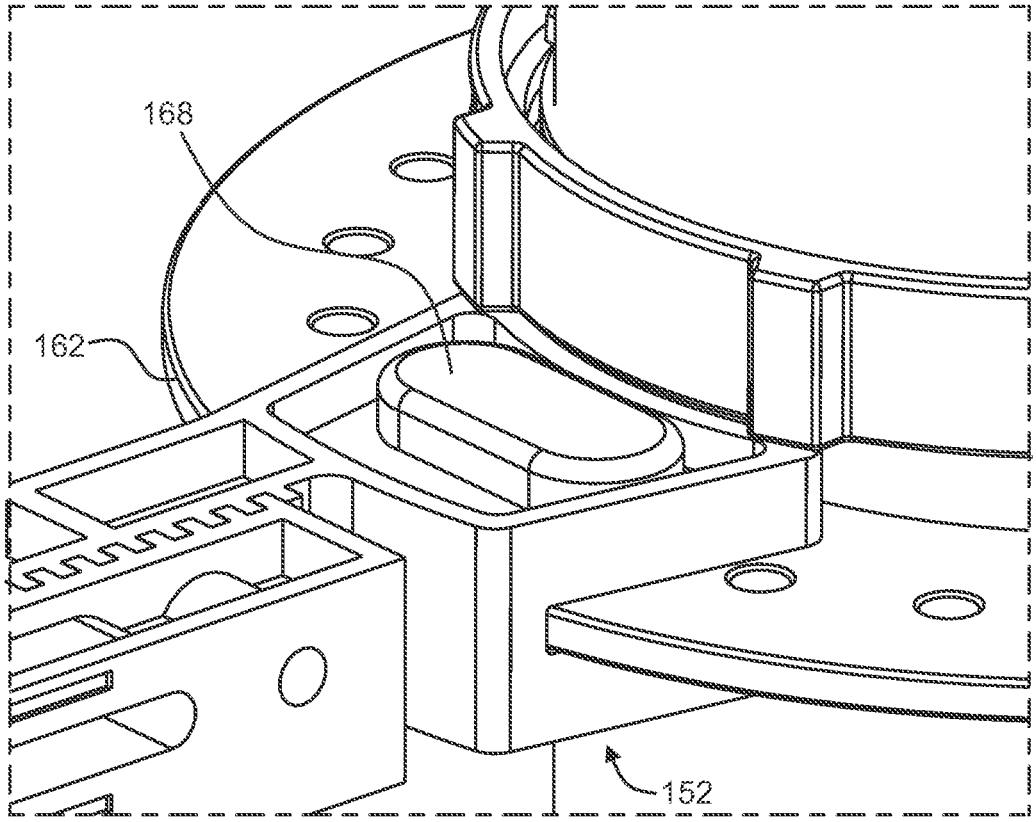
FIG. 31 is a diagrammatic partial perspective view similar to that of FIG. 30, but showing the fastener retention cap retaining the pair of fastener pins in place.
Figure 32:
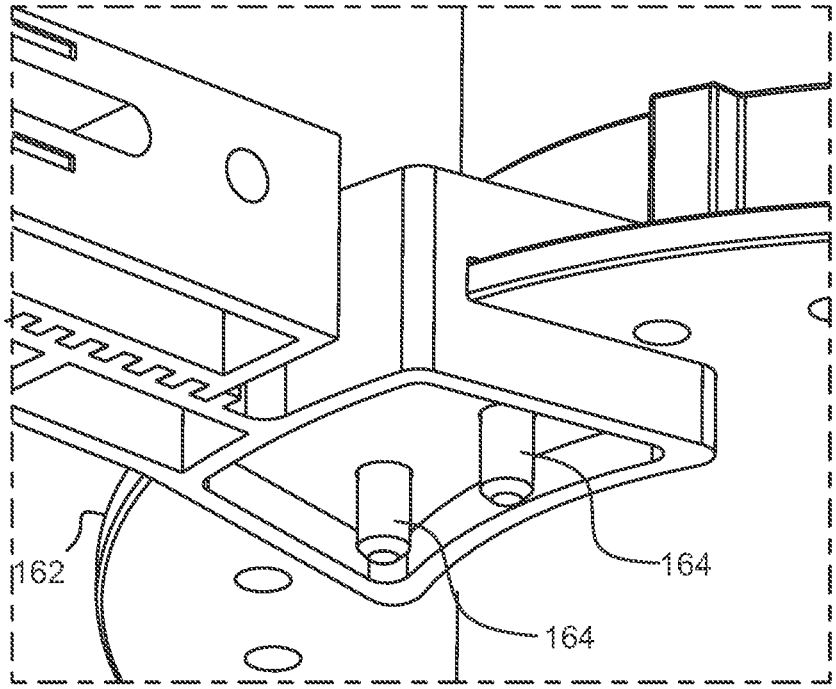
FIG. 32 is a further diagrammatic partial perspective view of the configuration of FIG. 31.
Figure 33:
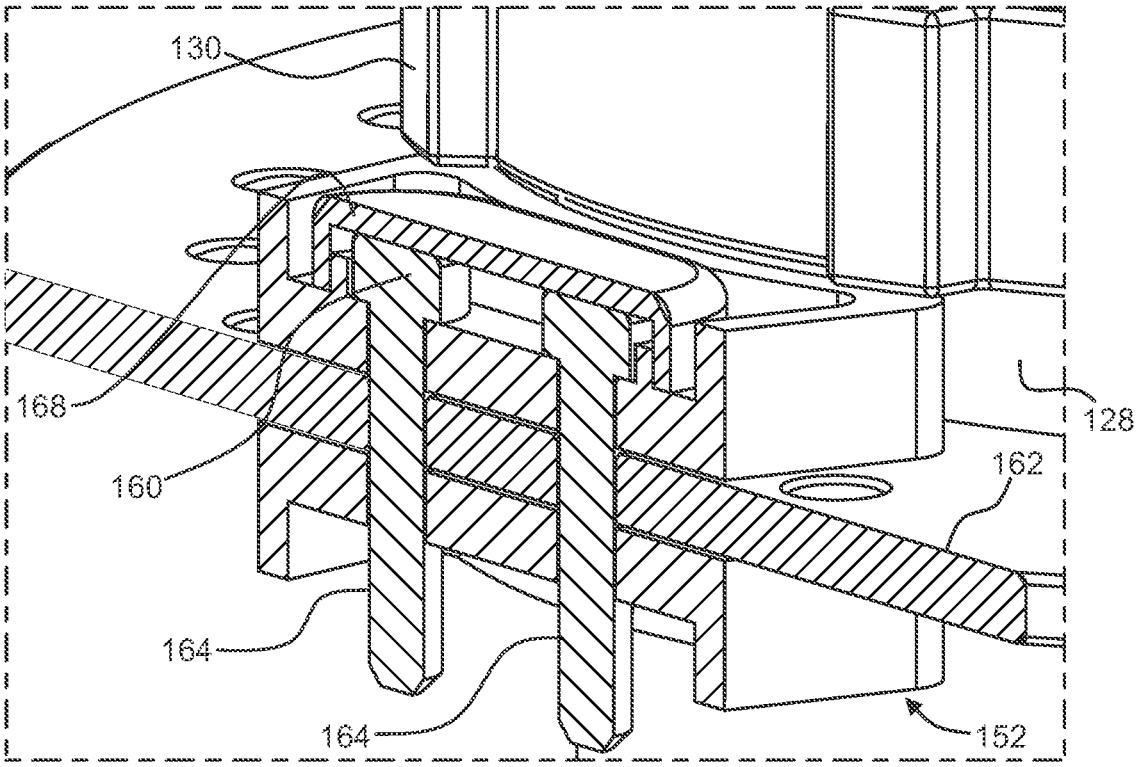
FIG. 33 is a diagrammatic cross-sectional view of the configuration of FIG. 31.
Figure 34:
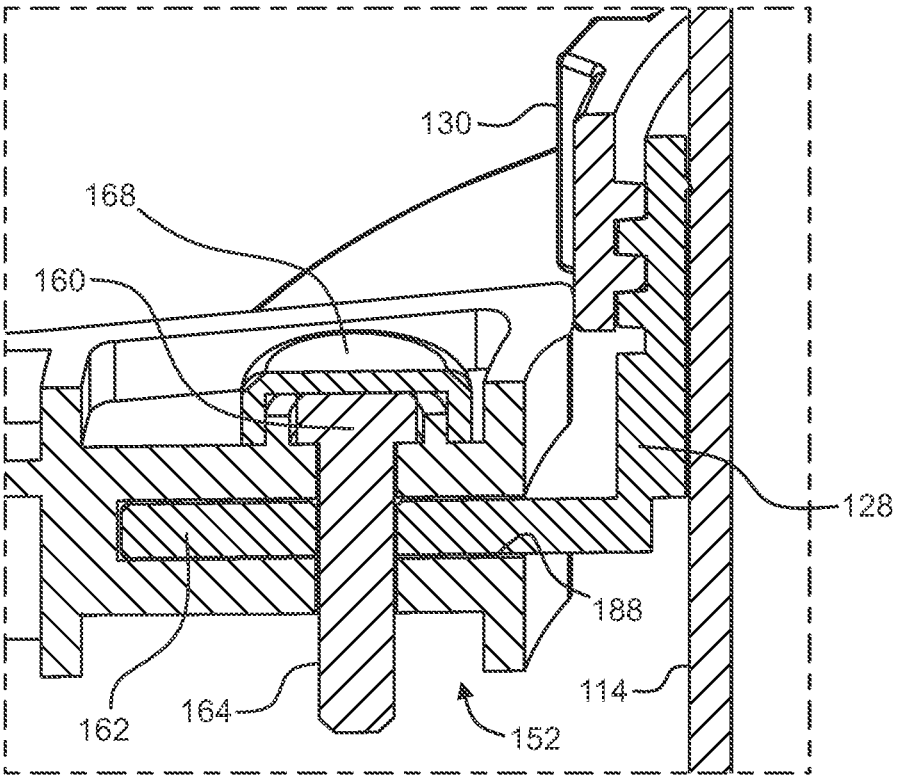
FIG. 34 is a further diagrammatic cross-sectional sectional view of the configuration of FIG. 31, but wherein the section line is perpendicular to that of FIG. 33.
Figure 35:
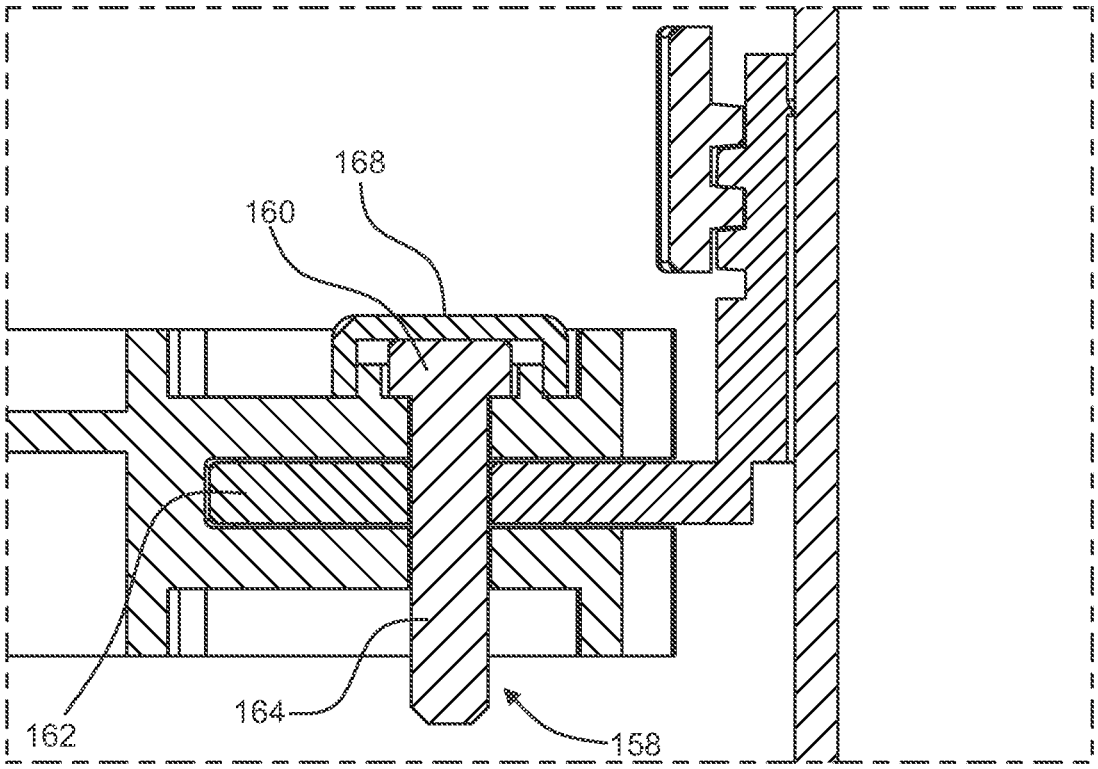
FIG. 35 is a further diagrammatic cross-sectional sectional view of the configuration of FIG. 31, taken along the same section line as in FIG. 34.

Referring to FIGS. 21, 25 and 28, in particular implementations of the system 100, the brace engagement portions are in the form of an annular flange 162.

Referring to FIGS. 6-7 and 15-17, each brace element 106 may include a pair of laterally-opposed brace arms 138 and at least one brace arm extension lock 140. The brace arms 138 may include at least one lock slot 148 and an arm interface portion 150 with an array of teeth. In such an embodiments, for each brace element 138, the array of teeth of one of the brace arms 138 may be configured to be secured in length-locking engagement with the array of teeth of the opposing brace arm 138. The length-locking engagement may be configured to prevent the brace element 106 from being lengthened or shortened. The brace arm extension lock 140 may be configured to be manually inserted through a respective lock slot 148 of each brace arm 138 and rotated 90 degrees to selectedly maintain the length-locking engagement. For example, referring to FIGS. 6 and 7, once the lock foot 146 and lock shaft 142 are passed through the corresponding lock slots 148, the lock head 144 can be twisted about the axis of the shaft 142 so as to cause the lock foot 146 to be out of alignment with the lock slots 148, thus preventing the lock foot 146 from passing back through the lock slots 148. As a result of this configuration, the brace arm extension lock 140 prevents the brace arms 138 from separating by trapping the mutually-engaged brace arms between the lock head 144 and lock foot 146, thereby maintaining the arrays of teeth 150 in engagement with one another. This effectively acts as a key-lock mechanism, without requiring threaded components such as a bolts and nuts. When the length of the brace element 106 needs to be adjusted, the brace arm extension lock 140 is rotated and removed, thereby allowing the brace arms 138 to be separated from, repositioned, and re-engaged with respect to one another.

Referring to FIGS. 29-35, in certain implementations of the brace flooring tray support system 100, the fastener pins 164 may include a radially-extending fastener head 160, and a removable fastener retention cap 168 configured to engage the pedestal interface portion 152 for retaining the respective fastener pins 164 within their pin alignment apertures (154, 156) and attachment apertures (134, 136).

The following listing matches certain terminology used within this disclosure with corresponding reference numbers used in the non-limiting examples illustrated in the several figures.

100 braced flooring tray support system
102 braced pedestal subsystem
104 pedestal element
106 brace element
108 tray element (e.g., to support flooring tiles or synthetic turf)
110 local horizontal substrate (e.g., pre-existing flooring or roofing surface)
112 pedestal engagement portion (of tray element)
114 pedestal tube (e.g., PVC pipe)
116 base element (of pedestal element)
118 securement interface (tray-to-pedestal)
120 tray support element
122 tray lock element
124 adjustment shuttle (e.g., threaded)
126 shuttle interface element
128 brace interface element
130 brace interface securement ring
132 attachment fin (type of brace engagement portion)
134 attachment aperture (e.g., in attachment fin or flange)
136 attachment aperture (e.g., in attachment fin or flange; e.g., arcuate)
138 brace arm (of brace element)
140 brace arm extension lock (e.g., removable locking key)
142 lock shaft
144 lock head
146 lock foot
148 lock slot (in brace arm)
150 arm interface portion (e.g., with array of teeth)
152 pedestal interface portion (e.g., fin/flange interface portion of brace arm)
154 first pin alignment aperture (of brace arm)
156 second pin alignment aperture (of brace arm)
158 brace fastener element (e.g., comprising one or more fastener pins)
160 fastener head
162 annular attachment flange (type of brace engagement portion)
164 fastener pin (e.g., threaded bolt, threadless pin, etc.)
166 detent portion (of fastener; e.g., snap feature, threaded nut, cotter pin, c-clip, etc.)
168 fastener retention cap (e.g., for retaining fastener pins in place)
170 fastener head recess
172 lock-disk slot (e.g., in each corner of tray element)
174 lock disk (e.g., Hex lock disk)
176 lock disk fastener (e.g., deck screw)
178 adjustable distance (from local horizontal substrate to top of pedestal element)
180 pedestal axis
182 brace axis
184 bracing angle
186 flooring element (e.g., deck tiles, synthetic turf, or the like)
188 slot (e.g., planar)
190 grip features (e.g., friction-inducing)
192 tray corner While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A braced flooring tray support system comprising:

(a) a braced pedestal subsystem including (i) a plurality of pedestal elements, each said pedestal element having a base element, a tray support element and a pedestal tube extending therebetween along a pedestal axis, at least two of said pedestal elements including a brace interface element, the brace interface elements having a plurality of attachment apertures; and (ii) a multiplicity of brace elements, each said brace element having an opposing pair of pedestal interface portions and extending in length-adjustable fashion therebetween along a respective brace axis; and (b) one or more tray elements, each said tray element having corners, each said corner being configured to supportedly engage a respective said tray support element;

wherein each said pedestal interface portion includes (i) a slot configured to engageably receive a brace engagement portion of a said brace interface element;

(ii) at least one pin alignment aperture intersecting the slot; and (iii) a corresponding brace fastener element configured to be manually installed in and removed from the pedestal interface portion, each said brace fastener element including at least one fastener pin configured to extend through a respective said pin alignment aperture and a respective said attachment aperture when the brace fastener element is installed; and wherein the brace interface elements include one or more radially-extending brace engagement portions through which the attachment apertures extend.

2. The brace flooring tray support system of claim 1, wherein each said pedestal interface portion includes a first said pin alignment aperture and a second said pin alignment aperture.

3. The brace flooring tray support system of claim 2, wherein the brace fastener elements are entirely removable and replaceable with respect to the pedestal interface portions and brace interface elements.

4. The brace flooring tray support system of claim 2, wherein in each pedestal interface portion (a) the slot is planar, and (b) the pin alignment apertures extend perpendicularly to the slots.

5. The brace flooring tray support system of claim 1, wherein, for each said brace fastener element:

the at least one fastener pin includes a detent portion configured to releasably secure the brace securement element within the pedestal interface portion when the brace fastener element is installed without requiring any threaded engagement.

6. The brace flooring tray support system of claim 5, wherein the detent portion is a snap feature.

7. The brace flooring tray support system of claim 2, wherein (a) the brace engagement portions are in the form of a vertical fin; and (b) each vertical fin includes a first attachment aperture and a second attachment aperture configured to respectively align with the first pin alignment aperture and second pin alignment aperture of a respective pedestal interface portion when the slot of the respective pedestal interface portion is in receipt of the vertical fin.

8. The brace flooring tray support system of claim 7, wherein each said brace interface element includes a plurality of said brace engagement portions distributed circumferentially about the brace interface element.

9. The brace flooring tray support system of claim 8, wherein the first attachment aperture or the second attachment aperture is arcuate.

10. The brace flooring tray support system of claim 9, wherein each said brace fastener element includes a fastener head and a pair of said fastener pins attached thereto.

11. The brace flooring tray support system of claim 10, wherein the fastener head includes grip features.

12. The brace flooring tray support system of claim 10, wherein the fastener head is configured to be removably press-fit into a fastener head recess within a said pedestal interface portion for retaining the respective fastener pins within their pin alignment apertures and attachment apertures.

13. The brace flooring tray support system of claim 7, wherein the brace interface elements are axially positionally adjustable along the respective pedestal tube.

14. The brace flooring tray support system of claim 2, wherein the brace engagement portions are in the form of an annular flange.

15. The brace flooring tray support system of claim 1, wherein (a) each said brace element includes a pair of laterally-opposed brace arms and at least one brace arm extension lock;

(b) each of said brace arms include at least one lock slot and an arm interface portion with an array of teeth; and (c) for each said brace element (i) the array of teeth of one of the brace arms is configured to be secured in length-locking engagement with the array of teeth of the opposing brace arm, the length-locking engagement being configured to prevent the brace element from being lengthened or shortened; and (ii) the brace arm extension lock is configured to be manually inserted through a respective said lock slot of each said brace arm and rotated 90 degrees to selectedly maintain the length-locking engagement.

16. The brace flooring tray support system of claim 1, wherein (a) the fastener pins include a radially-extending fastener head; and (b) the system includes a removable fastener retention cap configured to engage a said pedestal interface portion for retaining the respective fastener pins within their pin alignment apertures and attachment apertures.

17. The brace flooring tray support system of claim 4, wherein each said brace fastener element includes a fastener head and a pair of said fastener pins attached thereto.

18. The brace flooring tray support system of claim 17, wherein the fastener head includes grip features.

19. The brace flooring tray support system of claim 18, wherein the grip features are selected from the group consisting of knurling and laterally-extending bosses.

* * * * *